US011859386B2

(12) United States Patent
Low

(10) Patent No.: US 11,859,386 B2
(45) Date of Patent: Jan. 2, 2024

(54) CABLE-SUPPORTED STRUCTURAL ASSEMBLY WITH FLEXIBLE REINFORCED CONCRETE STRUCTURAL ELEMENT

(71) Applicant: Raymond Alan Low, Fresno, CA (US)

(72) Inventor: Raymond Alan Low, Fresno, CA (US)

( * ) Notice: Subject to any disclaimer, the term of this patent is extended or adjusted under 35 U.S.C. 154(b) by 17 days.

(21) Appl. No.: 17/943,067

(22) Filed: Sep. 12, 2022

(65) Prior Publication Data

US 2023/0075456 A1 Mar. 9, 2023

Related U.S. Application Data

(63) Continuation-in-part of application No. 17/836,226, filed on Jun. 9, 2022, now Pat. No. 11,619,047, which
(Continued)

(51) Int. Cl.
*E04C 5/07* (2006.01)
*E04C 5/08* (2006.01)
(Continued)

(52) U.S. Cl.
CPC ..... *E04C 5/07* (2013.01); *E04C 3/26* (2013.01); *E04C 3/34* (2013.01); *E04C 5/08* (2013.01)

(58) Field of Classification Search
CPC ..... E04C 5/07; E04C 3/26; E04C 3/34; E04C 5/08; E04C 5/0618; E04C 5/012;
(Continued)

(56) References Cited

U.S. PATENT DOCUMENTS 2,358,758 A * 9/1944 Eames ..... E04C 5/07 264/258
4,694,622 A * 9/1987 Richard ..... B28B 3/00 52/223.5
(Continued)

FOREIGN PATENT DOCUMENTS

CA 2429927 A1 * 11/2004 ..... E04C 5/0609
CH 691608 A5 * 8/2001 ..... E04C 5/07
(Continued)

*Primary Examiner* — Babajide A Demuren
(74) *Attorney, Agent, or Firm* — JAQUEZ LAND GREENHAUS & McFARLAND LLP; James D. McFarland, Esq.

(57) ABSTRACT

A structural assembly utilizing a reinforced concrete support element with a flexibly-braided reinforcement sleeve and a cable system for building structures. The reinforced concrete BMASS element has an approximately cylindrical shape and includes a substantially solid concrete core. An outer reinforcement sleeve with a flexible multi-axially braided configuration is embedded on the perimeter, and an inner reinforcement sleeve is embedded within the outer sleeve. A cable tension system connected between the ends of the BMASS element transmits tensile force from the cable to the BMASS element. The structural assembly can be configured as a beam or a column. In a beam configuration, the tensioned cable can also provide beam curvature and greater strength. A multi-cable embodiment includes a second cable, providing additional strength and greater ability to control curvature. One or more of the braces may include an adjustable arm. The tension may be adjusted manually, or remotely.

20 Claims, 22 Drawing Sheets

Related U.S. Application Data is a continuation-in-part of application No. 16/996,905, filed on Aug. 19, 2020, now Pat. No. 11,408,176.

(60) Provisional application No. 62/888,854, filed on Aug. 19, 2019.

(51) Int. Cl.
*E04C 3/26* (2006.01)
*E04C 3/34* (2006.01)

(58) Field of Classification Search
CPC . E04C 3/36; E04C 3/30; E04C 5/0613; E04C 5/0622; E04C 5/0627; E04G 9/08
See application file for complete search history.

(56) References Cited

U.S. PATENT DOCUMENTS 5,218,810 A * 6/1993 Isley, Jr. ..... E04G 23/0218 52/249
5,299,445 A * 4/1994 Yee ..... E04C 3/44 52/745.19
5,599,599 A * 2/1997 Mirmiran ..... E04C 5/07 428/36.3
5,671,572 A * 9/1997 Siller-Franco ..... E04G 23/0218 52/223.13
5,671,573 A * 9/1997 Tadros ..... E04C 3/205 52/855
6,189,286 B1 * 2/2001 Seible ..... E04C 3/44 52/834
6,295,782 B1 * 10/2001 Fyfe ..... E04C 5/07 52/359
2005/0229532 A1 * 10/2005 Teng ..... E04C 3/29 52/834

FOREIGN PATENT DOCUMENTS

CN 102877465 A * 1/2013
CN 105672574 A * 6/2016
CN 106677345 A * 5/2017 ..... E02B 17/00
FR 2985748 A1 * 7/2013 ..... E04C 3/36
KR 100819169 B1 * 4/2008
KR 20150066995 A * 6/2015
WO WO-9738183 A1 * 10/1997 ..... E04C 3/34

* cited by examiner

CABLE-SUPPORTED STRUCTURAL ASSEMBLY WITH FLEXIBLE REINFORCED CONCRETE STRUCTURAL ELEMENT

PRIORITY

Reference is made, and priority is hereby claimed to co-pending U.S. patent application Ser. No. 17/836,226, filed Jun. 9, 2022, entitled BRAIDED MULTI-AXIAL SLEEVE SYSTEM USED AS A STRUCTURAL REINFORCEMENT FOR CONCRETE COLUMNS AND METHOD FOR CONSTRUCTING CONCRETE COLUMNS, U.S. patent application Ser. No. 16/996,905, filed Aug. 19, 2020, entitled MULTI-AXIALLY BRAIDED REINFORCEMENT SLEEVE FOR CONCRETE COLUMNS AND METHOD FOR CONSTRUCTING CONCRETE COLUMNS, now U.S. Pat. No. 11,408,176, issued Aug. 9, 2022, and U.S. Provisional Patent Application No. 62/888,854, filed Aug. 19, 2019, entitled MULTI-AXIALLY BRAIDED REINFORCEMENT SLEEVE FOR CONCRETE COLUMNS AND METHOD FOR CONSTRUCTING CONCRETE COLUMNS, all of which are incorporated herein by reference.

BACKGROUND

Technical Field

The invention relates to materials, components, and construction techniques for forming structural elements for building structures, such as buildings, bridges, parking garages and towers, using concrete aggregate.

2. Description of Related Art

All structures—from huts to skyscrapers and bridges—utilize structural elements to hold them up and keep them from collapsing. Two key structural elements are beams and columns, and each plays an essential role in creating a load path to safely transfer the weight and forces acting on a structure to the foundation and into the ground.

Beams are horizontal structural elements that withstand vertical loads, shear forces, and bending moments. Beams transfer loads imposed along their horizontal length to endpoints, such as columns, walls, and foundations Columns are vertical support structures that hold up beams, roofs, and other parts of a building. Generally, a column is a strong, typically cylindrical structure that can, for example, extend from floor to ceiling inside a structure, or outside, from the ground up to the first, second or subsequent floors. Each column is designed with the compressive strength to hold the weight of what is above it, which can be very substantial. To construct vertical support structures, conventional construction techniques utilize concrete aggregate in combination with reinforcement materials such as rebar.

Concrete aggregate is commonly used in the construction industry. Concrete aggregate includes cement in various combinations with water, sand, gravel, and other materials that help add to its strength in the particular conditions in which the concrete will be employed. For ease of reference, the term "concrete" as used herein includes any of these combinations of cement and other materials that form a concrete aggregate.

Concrete has many advantages, including great compressive strength, good longevity with little maintenance, and it is relatively impervious to weather. However, there are some disadvantages to using concrete to construct columns. One disadvantage is concrete's low tensile strength. For example, if a column were to be made solely of concrete, it would crack and break relatively easily when subjected to tensile axial forces. To compensate for the low tensile strength, an internal structure is commonly utilized. For example, an internal structure may include one or more rebar rods situated vertically inside the column to improve the concrete column's tensile strength.

Under normal stress loads and environmental conditions, rebar rods as internal structures function well with concrete and provide good support for concrete columns. However, under the extreme conditions of fire, corrosion, or earthquakes, the steel reinforcement bars destroy the very members they were designed to save. For example, corroding steel reinforcement alone costs every country 3 to 4% of its GDP in maintenance, repair, or replacement. Likewise, when steel reinforcement is directly exposed to fire, the rebar will rapidly rise in temperature and cause the loss of the concrete cover due to spalling, which will significantly reduce the load-carrying capacity of the concrete member. When concrete columns are laterally loaded, as in an earthquake, the vertical rebar is placed in the precarious position of alternating between being placed under compression, then under tension, and then back again. When under tension, the vertical rebar elongates axially, breaking its bond with the concrete and allowing the concrete to crack. As the column bends back on the return swing, the rebar is now under compression, with all of the column's gravitational load placed on it. The vertical rebar now expands, cracking the concrete even more, spalling the concrete cover, eventually buckling, and forcefully ejecting the concrete core from its reinforcement cage, causing the column to fail, which in turn can bring down an entire building, or at least a portion of it.

Another disadvantage of rebar-reinforced concrete structural elements is their construction cost, which can be substantial. To construct a concrete column or beam, workers first install the rebar cage into a suitable foundation, then build formwork around the rebar cage that defines the column or beam, and then build a frame that holds the column or beam in place. Then the concrete is poured, and after it dries, the frame and formwork are removed and eventually discarded at the end of the project. Although sometimes formwork can be reused during the scope of a project, the ability to reuse it is limited. For example, if the formwork is unique, it can't be reused and will be discarded. Still another disadvantage is that rebar is heavy and can be expensive to transport, especially for pre-formed structures.

The conventional multi-step construction technique described above using rebar, formwork, and frames, adds significant labor and material costs to the total construction cost of a building. Unfortunately, it also creates several additional construction and practical problems such as concrete honeycombing in the formwork; cold joints; bug holes; cracking concrete during form removal; over-vibration which can cause formwork blowout; formwork failures; improper construction due to workers' lack of attention to formwork details; possible removal of formwork too early; the extensive time needed to plan for formwork, stripping time requirements and storage requirements; determining the capacity of equipment available to handle form sections and materials; determining the capacity of mixing and placing equipment; determining suitability for reuse of forms as affected by stripping time; considering the relative merits of job-built, shop-built and ready-made forms; and weather-related problems (such as rain or snow) that can adversely affect the formwork.

It would be an advantage to provide an improved system and method for constructing concrete columns and beams that have a lower cost, and better resistance against extreme events such as corrosion, fire, and earthquake damage. It would also be an advantage if the construction of the columns and beams could be easier, quicker, and safer.

SUMMARY

A structural assembly utilizing a reinforced concrete support element with a braided reinforcement sleeve and a cable reinforcement system is described for constructing structural support elements for buildings and other structures. The reinforced concrete structural element, termed herein a "BMASS support element" or "BMASS element", and a method for constructing and utilizing concrete structural elements are described, which can provide a low-cost, simpler method to form strong concrete structural elements for buildings and other structures that is quicker and safer.

Various embodiments of a cable-supported structural assembly for constructing structures are disclosed herein. These embodiments utilize a reinforced concrete BMASS element that has an approximately cylindrical shape having a first end and a second end, including a substantially solid concrete core consisting essentially of concrete. An outer multi-axially braided reinforcement sleeve with a flexibly braided configuration is embedded in the concrete on the perimeter of the core. An inner reinforcement sleeve is embedded in the concrete situated concentrically within the outer reinforcement sleeve. Both the outer and inner reinforcement sleeves provide reinforcement for the BMASS element.

In one embodiment, a cable tension system is connected between a first end and a second end of the BMASS element, including a cable having a first end connected proximate to the first end of the BMASS element, and a second end connected proximate to the second end of the BMASS element; and a brace connected to the BMASS element between the two ends. The brace is connected to the cable to transmit tension from the cable to the BMASS element.

Embodiments are disclosed in which the structural assembly is configured as a beam. Other embodiments are disclosed in which the structural assembly is configured as a column.

In a beam configuration, the tensioned cable provides an axial compressive force to the BMASS element, and can also be provide beam curvature to provide greater strength. A multi-cable embodiment is disclosed that includes a second cable, which provides additional strength and a greater ability to control curvature.

An embodiment is disclosed in which the brace includes an adjustable arm that can be used to lengthen or shorten the arm and thereby adjust the tension of the cable and force applied to the BMASS element. The length can be changed manually, or remotely. In an embodiment where the length is changed remotely, a length control unit may be provided, connected to the adjustable arm. When the support arm is lengthened, it creates compressive forces in the support arm, which translates the tension in the cable to the BMASS element. In other words, the compressive forces in the support arm can be adjusted to provide strength to the structural assembly, at appropriate positions on the BMASS element. Because the BMASS element has some flexibility, its configuration can be adjusted; for example, adjustments can be made to add or maintain curvature, or correct distortions in the BMASS element, and thereby provide greater support and reduce the chances of failure.

In a column configuration, the assembly arranges the BMASS element in a column (vertical) configuration. The column configuration includes a multi-cable tension system including at least three cables arranged axially in an approximately equal angle distribution around the BMASS element. A plurality of braces is connected to the BMASS element and transmit tension from the cable to the BMASS element. Advantageously, the cable tension of the three cables may be selected to provide an approximately straight BMASS element, which provides the best compressive strength. Embodiments are disclosed in which a plurality of braces affixed along the BMASS element and connected to the cables. Each brace includes a collar situated around the BMASS element, a plurality of support arms connected to the collar, and a plurality of cable pass-throughs.

BRIEF DESCRIPTION OF THE DRAWINGS

For a more complete understanding of this invention, reference is now made to the following detailed description of the embodiments as illustrated in the accompanying drawing, wherein:

FIG. 3A shows a circular cross-section, FIG. 3B shows a rectangular cross-section, FIG. 3C shows a flat rectangular ribbon cross-section, and FIG. 3D shows a thin rectangular band cross-section.

FIG. 8A shows the beginning flow of cement paste out through the gaps in the sleeve, FIG. 8B shows the sleeve strands covered by concrete paste after flowing into the gaps 140, and FIG. 8C shows the concrete layer formed after the cement paste dries.

FIG. 21 is a perspective view of a single-arm brace that includes a collar, a single support arm, and a cable pass-through.

DETAILED DESCRIPTION

Figure 1:
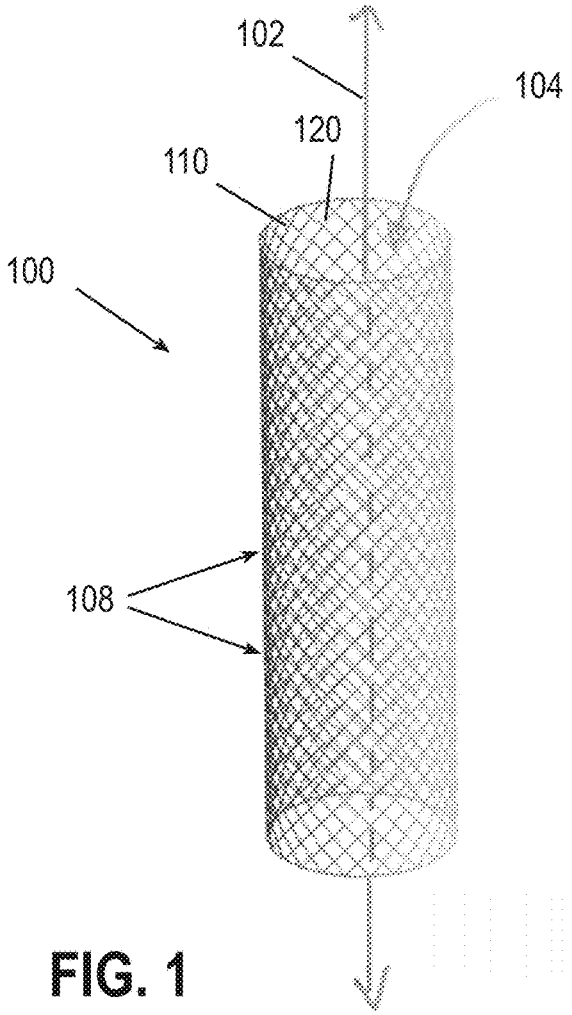
FIG. 1 is a perspective view of a multi-axially braided reinforcement sleeve in an extended configuration.

As used herein, the term "concrete", or "concrete aggregate" includes cement in various combinations with water, sand, gravel, rocks, and other materials that help to add to its strength in the particular conditions in which the concrete will be employed. For ease of reference, the term "concrete" as used herein includes any of these combinations of cement and other materials.

For purposes herein, concrete can be defined as including a cement paste, a coarse aggregate, and other materials such as sand. The term "coarse aggregate" includes larger solids, like rock and gravel. The term "cement paste" includes water mixed with cement. When fresh, cement paste typically flows in a semi-liquid manner.

A concrete support structure including a multi-axially braided reinforcement sleeve is described for constructing support elements for buildings and other structures. The support elements are described in the context of columns, similar principles can be applied to create other support structures such as beams.

(1) OVERVIEW AND ADVANTAGES OF BMASS ELEMENT AND

Multiple embodiments are described. In one embodiment a structurally reinforced concrete structural element for constructing buildings comprises a substantially solid concrete core consisting essentially of concrete with an outer multi-axially braided reinforcement sleeve embedded in the concrete on the perimeter of the core. This outer reinforcement sleeve has a flexible, multi-axially braided configuration and an inner reinforcement sleeve embedded in the concrete, situated concentrically within the outer reinforcement sleeve. Together, the outer and inner reinforcement sleeves provide flexible reinforcement for the concrete structural element. The outer reinforcement sleeve may have a biaxially or triaxially braided configuration in which a plurality of strands is oriented parallel and some being oblique with the central axis of the structural element. The inner reinforcement sleeve may include a plurality of strands that are oriented substantially lateral or transverse to the central axis. The outer and inner reinforcement sleeves have a weave that is substantially flexible and does not contain polymer resins that would otherwise interfere with sleeve flexibility. The plurality of strands in the outer and inner reinforcement sleeves may be substantially inelastic, and flexibility in the sleeves is provided by the weave of the strands in the sleeve. This concrete structural element is strong, reinforced with the inner and outer sleeves, and therefore the rebar that is normally used for axial support can be eliminated.

The multi-axially braided reinforcement sleeve can be manufactured inexpensively, and the disclosed construction method eliminates several steps from conventional construction methods, thus reducing the overall cost of constructing a concrete structural element. Advantageously, the rebar that normally is embedded axially in the structural element can be eliminated, along with the frame and formwork. Elimination of the rebar further reduces cost, and the multi-axially braided reinforcement sleeve provides tensile axial support to the structural element as well as stronger resistance to earthquake damage and further eliminates the possibility of rebar corrosion which would otherwise undermine the structural integrity of the structural element.

As an additional advantage, the multi-axially braided reinforcement sleeve is relatively lightweight (especially compared to rebar), easy to transport, and it can be reduced in size to facilitate transportation, in some embodiments, even collapsed and rolled on a reel. The size reduction allows the reinforcement sleeve to be transported without special requirements, thereby reducing cost.

Construction using the multi-axially braided reinforcement sleeve has several advantages. One advantage is the time and cost savings resulting from the elimination of formwork, installation, and removal. With no formwork, there is much less chance of damaging the concrete structural element or cracking the concrete, which could otherwise happen when the formwork is removed. Another advantage of eliminating the formwork is that there is no honeycombing in the concrete, which can be caused by air trapped between the formwork and the concrete, and no bug holes to repair.

Using a pre-manufactured multi-axially braided reinforcement sleeve eliminates the construction problems related to unskilled labor such as improperly detailing the rebar cage, using insufficient ties, or failing to give appropriate attention to formwork.

Another advantage is improved safety. Because the multi-axially braided reinforcement sleeve is positioned before the concrete is poured, remains in place after the concrete is poured, and doesn't require formwork, the often-fatal accidents related to formwork failures that can (and have) happened can be prevented. For example, eliminating formwork prevents accidents that might otherwise happen if formwork is removed too early (before the concrete is adequately cured and not structurally sound). It would also prevent accidents that could otherwise happen when the formwork itself fails for reasons such as poor design, reusing formwork that has lost its integrity even if it passes visual inspection or just human error.

The multi-axially braided reinforcement sleeve can be made in many different configurations, which can be designed and/or selected to meet the requirements of a large variety of construction jobs. To choose the appropriate configuration for a particular construction job, one consideration is the tensile strength of the sleeve. Generally, a sleeve is selected to have a weave pattern and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were used, or if the formwork becomes over-vibrated which can cause separation of concrete mixtures, increased pressures, and subsequent blowouts in the formwork.

Construction using the reinforcement sleeve also eliminates the need to clean, inspect, transport, and store formwork, which would otherwise consume a tremendous amount of time and add costs during the construction project.

The reinforcement sleeve has a multi-axially braided configuration which provides a weaved pattern that defines a plurality of gaps. The weaved pattern and material allow cement paste to flow into and around the fibers of the sleeve, sufficiently that the sleeve becomes bonded to the concrete structural element while holding the coarse concrete aggregate inside the sleeve. Advantageously, the flow of cement paste (and maybe some sand or smaller particles) through the gaps expels unwanted air and fills the spaces within the sleeve, so that the sleeve can become almost uniformly filled with concrete. A more uniform fill provides a stronger structure, substantially free of air pockets that might otherwise undermine the structural element's strength.

The multi-axially weaved structure is particularly useful because it defines a type of selective locking mechanism. The weave is close (tight) enough that it contains the concrete within the sleeve. In some embodiments, some gaps can have a size to allow some of the sand and cement paste to flow through the gaps in the sleeve, and this flow-through material can then be spread around the exterior of the sleeve, and after drying, becomes the cover for the structural element itself. In other words, in some implementations, the gaps may be large enough to allow cement paste to flow through to the outside, which can then be smoothed to create a substantially smooth external surface that can provide a better appearance.

Another advantage is that rebar can be eliminated from the structural element in many embodiments. Not only does rebar add to cost, but it is believed that the properties of the rebar itself can contribute to the destruction of the structural element during extreme events such as fire, corrosion, or an earthquake. The elimination of rebar prevents these problems, and the multi-axially braided reinforcement sleeve allows the structural element to retain most of its strength during and after these extreme events.

(2) MULTI-AXIAL BRAIDED REINFORCEMENT SLEEVE

Figure 2:
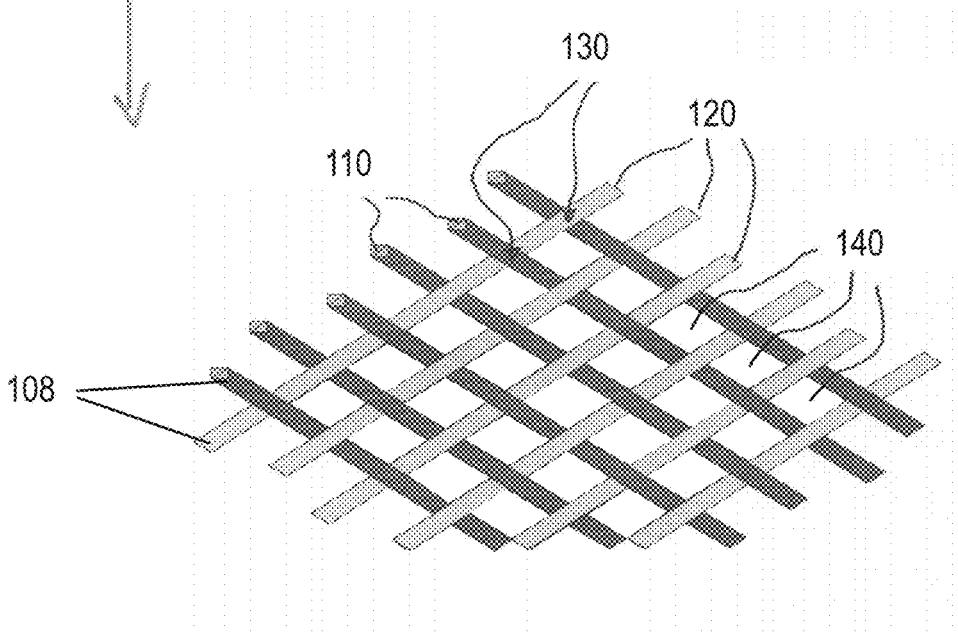
FIG. 2 is a perspective close-up view of a section of a biaxially braided reinforcement sleeve.

Reference is first made to FIGS. 1 and 2. FIG. 1 is a perspective view of a multi-axially braided reinforcement sleeve 100 in an extended configuration, and FIG. 2 is a perspective closeup view of a cut-out portion of the biaxially braided reinforcement sleeve 100. As shown in FIGS. 1 and 2, the multi-axially braided sleeve 100 for use in constructing a concrete column includes a plurality of strands 108 including at least a first plurality 110 of strands and a second plurality 120 of strands axially braided around a central axis 102 into a tubular braided structure that defines the sleeve 100 and a defines a central opening 104 axially through the tubular structure. Particularly, the first plurality of strands 110 are axially braided following a first rotation and the second plurality of strands 120 are axially braided following a second rotation counter-rotating to the first rotation. Thus, the first plurality of strands crosses the second plurality of strands at a plurality of crossings 130, and the crossed pattern of the first and second plurality defines a plurality of gaps 140.

The gaps 140 may or may not allow some cement paste to flow through to the outside while holding the concrete inside the sleeve. Advantageously, the flow of some cement paste (and maybe some sand or smaller particles) through the gaps expels unwanted air and fills the spaces within the sleeve, so that the sleeve column becomes approximately uniformly filled with concrete. A more uniform fill provides a stronger column structure substantially free of air pockets that might otherwise undermine the column's strength. The multi-axially weaved structure is particularly useful because it defines a type of selective locking mechanism.

In some embodiments, such as the embodiment illustrated in FIG. 1 and FIG. 2, the braided reinforcement sleeve 100 has a biaxial weave pattern (the braid follows two counter-rotating axes) that defines the plurality of gaps 140 between the strands 108, and the plurality of strand crossings 130 where the strands cross. In other embodiments, such as will be described with reference to FIGS. 12 and 13, the weave pattern can be triaxial, in which the first and second plurality of strands cross as in the biaxial configuration, and a third plurality of strands are oriented substantially parallel with the axis of the column. In still other embodiments, such as will be described with reference to FIGS. 14 and 15, the triaxial sleeve 1200 combines with an inner sleeve 1400 that has a plurality of substantially unidirectional strands, oriented transverse to the central axis of the sleeve.

The material used in the strands 108 can be any material such as metal, plastic, nylon, ceramics, basalt, aramid, carbon fiber, glass fiber, or any natural or synthetic material of suitable strength and durability that has the appropriate characteristics for the desired end application. Generally, the strands are relatively inelastic.

Figure 3A:
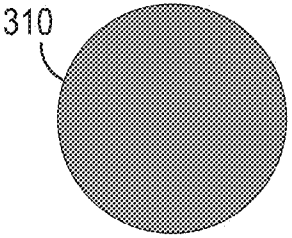
FIGS. 3A, 3B, 3C, and 3D are cross-sectional views of several different strand configurations.
Figure 3B:
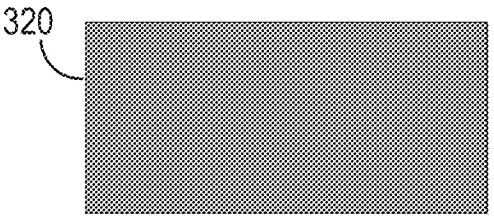
Figure 3C:
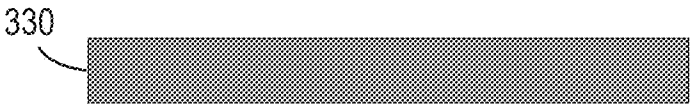
Figure 3D:
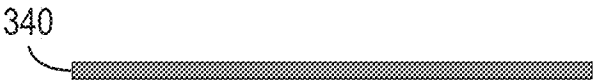

FIGS. 3A, 3B, 3C, and 3D are example configurations for each single strand 108, illustrating that the strands can have different forms and configurations. The strands can have any suitable configuration. FIG. 3A shows a circular cross-section 310 like a wire, FIG. 3B shows a rectangular cross-section 320, FIG. 3C shows a flat rectangular ribbon cross-section 330, and FIG. 3D shows a thin rectangular band cross-section 340. To choose the appropriate configuration for a particular construction job, one consideration is the strength and flexibility of the sleeve. Generally, a sleeve is selected to have a weave pattern, a strand configuration, and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were to be used, or if the formwork was over-vibrated which can otherwise cause separation of concrete mixtures, increased hydrostatic pressures, and subsequent blowouts in the formwork.

Although typically the materials and strand configurations will be consistent throughout the sleeve, in some embodiments some strands may comprise different materials and/or different configurations. For example, in the same sleeve, some strands may be nylon and others may be aramid, some strands may have a wire configuration and others may have a band configuration. The materials and configuration of the strands are chosen based on their properties to create the desired strength, flexibility, and weave pattern of the end product sleeve.

Many different types of strands can be used in the multi-axially braided reinforcement sleeve. Examples of these strands include the following:

1) ⅛ inch circular wire;
2) Strands can be comprised of thousands of filaments which are only about 5 to 10 microns thick, 3k, 6k, 12k and 15k, where k means thousands of filaments, can be found in each strand
3) The strands could be metal bands % an inch to 3 inches wide that are weaved into a sleeve; similar to the metal bands that hold lumber together for transport; and
4) The material of the strands could be nylon, basalt, aramid, glass fiber, carbon fiber, or any synthetic or natural material of suitable strength and durability that can be woven into reinforcement sleeves.

Generally, the material and configuration of the strands are chosen to be relatively inelastic compared to the sleeve. For example, individual strands made of metal may not bend or stretch easily (i.e., they may be relatively inelastic). However, the overall braided sleeve will be substantially flexible due to its braided pattern, even if the individual strands are inelastic.

As shown in FIG. 2, the multi-axial braiding 100 of the strands 108 provides a weaved pattern that defines the plurality of crossings 130 and may or may not have some gaps 140. The gaps 140 may or may not allow some cement paste to flow through to the outside while holding the concrete aggregate inside the sleeve.

The particular weave pattern depends upon several factors such as design requirements, the properties of the concrete mixture, and the outside temperature. Different types of concrete may require a different weave pattern, angle of weave, and type of reinforcement bands/ribbons. The type of concrete can change, and the compression stress of concrete can vary anywhere from less than 3,000 psi to over 10,000 psi, the water/cement ratio can vary depending on weather conditions, the size of the pour, and the type of cement that is used. All these factors can be considered when selecting the appropriate sleeve for a particular installation.

(3) FABRICATING THE MULTI-AXIALLY BRAIDED REINFORCEMENT SLEEVE

Fabricating the multi-axially braided reinforcement sleeve can be accomplished using any suitable method. Many braiding methods are known in the art, and the particular method chosen for forming the braided tubular structure will depend upon the requirements of any particular implementation. A few examples of methods and apparatus that can braid strands to create a tubular configuration are shown in US Patent Publication US20150299916, U.S. Pat. Nos. 7,311,031, 5,257,571, and 5,099,744.

As described above, the configuration of the strands 108, given the material, must be thick enough or of such density to substantially contain the concrete in the weaved pattern. The strands may be relatively inelastic for strength, and the braid pattern provides flexibility to the reinforcement sleeve.

In one embodiment, the braided sleeve has a biaxial weave pattern in which the first set of strands are wrapped around the central axis in a first rotation, and the second set of strands are wrapped around the central axis in a second, opposite rotation. In other embodiments, the braided sleeve may have a triaxial weave pattern, or a combination of an inner sleeve (comprised of a biaxial weave nearly lateral to the length of the column) and an outer sleeve (comprised of a triaxial weave pattern along the length of the column) working together, or other suitable weave patterns.

Many different materials and configurations can be implemented. Typically, the braided structure will be formed with a uniform braid pattern throughout its length. Still, many variations are possible with a uniform braid pattern, for example, the weaved pattern could include a finer mesh that would hold in place a stronger but looser weave of a different material. For example, the weaved pattern could include a finer nylon mesh that holds heavier aramid belts that are weaved into sleeves.

In some embodiments, it may be useful to vary the braid pattern in certain areas, so that the braid is nonuniform along its length. For example, one embodiment may create additional strength in certain portions of the sleeve by a tighter weave, or in other embodiments, more flexibility in the braid can be provided by using a looser weave.

Note that the flexibility of the reinforcement sleeve would be adversely affected by the use of resins/polymers on the sleeve as the resins would harden and impair flexibility. The use of resins/polymers on the sleeve should be avoided because of their low melting point, toxin fumes when burnt, and incompatibility with concrete.

(4) METHOD OF COLUMN CONSTRUCTION

To recap the conventional construction method discussed above in the prior art section, in conventional concrete column methods, workers first install vertically-extending rebar rods into a suitable foundation, then build formwork around the rebar to define the column, and then build a frame that holds it all in place. Then the concrete is poured in, and after it dries, the frame and formwork are removed. This conventional multi-step construction technique has several disadvantages, such as adding significant labor and material costs to the total construction cost of a building, creating safety issues, and lengthening the construction time. Furthermore, in extreme events such as a fire, corrosion, or an earthquake, the columns may fail, and the rebar itself contributes to the failure of the column.

The method described herein simplifies construction by eliminating conventional formwork and replacing it with a pre-manufactured multi-axially braided sleeve. The ceiling holds the sleeve in place on its upper end, and the floor provides a foundation at the lower end. Conventional axial rebar and ties are optional and may be eliminated; for some uses, rebar may be eliminated entirely. For other uses, if extra strength is required, some amount of rebar may be desirable and placed within the multi-axially braided sleeve.

Figure 4:
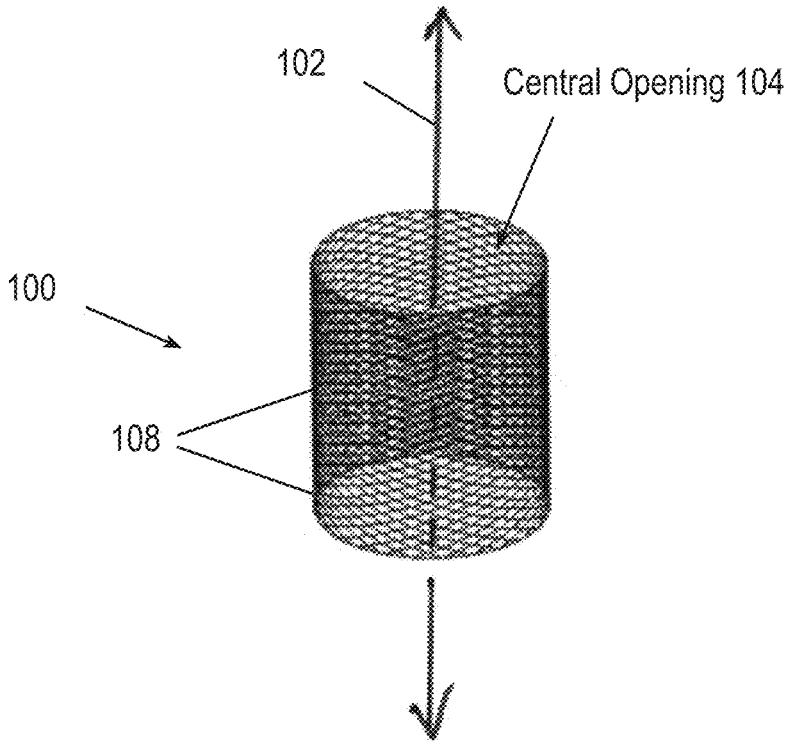
FIG. 4 is a perspective view of the multi-axially braided reinforcement sleeve compressed (packed down) to a reduced size that may be used for transportation.

FIG. 4 is a perspective view of the reinforcement sleeve 100 compressed (packed down) to a reduced size for transportation. The reinforcement sleeve 100 can also be flattened and rolled on a reel, or folded. In FIG. 4 the sleeve is shown compressed along its axis 102 and can be folded, but more generally the sleeve can be flattened and rolled on a reel in any manner suitable to the materials and configuration of the strands 108.

Figure 5:
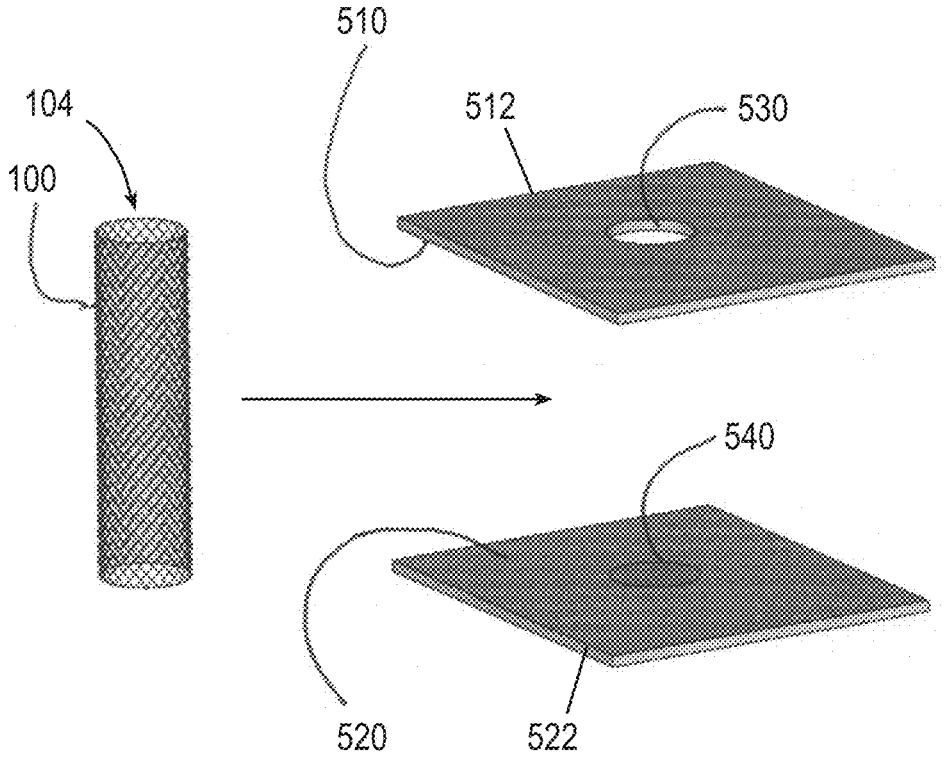
FIG. 5 is a perspective view of an installation location, including an upper and a lower surface defined on upper and lower structures, and a sleeve.

FIG. 5 is a perspective view of a location prepared for installing a concrete column with the reinforcement sleeve 100. The installation location includes an upper surface 510 shown on a section of an upper structure 512 (e.g., a ceiling) and a lower surface 520 shown on a section of a lower structure 522 (e.g., a floor) to which the reinforcement sleeve 100 is affixed.

One way to install a column is to pour the columns remotely (as modules) and then move the poured columns to the installation location. Such pre-casted forms could also be pultruded through dies and cut to length. Pultrusion is a continuous process for manufacture with an approximate constant cross-section by pulling the material, as opposed to extrusion which pushes the material.

Another way is to attach the respective ends of the reinforcement sleeve 100 to the upper surface 510 and lower surface 520 using any suitable attachment method, such as tying the reinforcement sleeve 100 into the existing rebar found in the floor and ceiling concrete slabs.

In some embodiments, the joint at the end of the column may be a straight cylinder (see. FIG. 11) whereas in other embodiments (see FIGS. 6, 7, and 10) the reinforcement sleeve may flare at the end like a cone of increasing diameter, or a vase-like structure that expands out from near the end of the column to the adjacent surface or foundation. The expanding joint support would also increase strength and ductility in the column-to-beam and column slab connections.

If joint support tying into the existing rebar in the floor and ceiling concrete slabs is not used, the concrete columns could be poured at another location, transported, lifted into place, and attached with grouted dowels.

In the embodiment of FIG. 5, an opening 530 in the upper surface 510 is provided to allow the concrete to be poured into the central top opening as is done with conventional formwork. Generally, the central opening 104 of the reinforcement sleeve 100 must be accessible in some manner, so that concrete can be poured in. If there are circumstances where the opening at the top of the column is not available, spreaders could be used to create an opening in the side of the reinforcement sleeve through which concrete can be poured, and then the spreaders can be removed, and the sleeve reassembled or mended.

Figure 6:
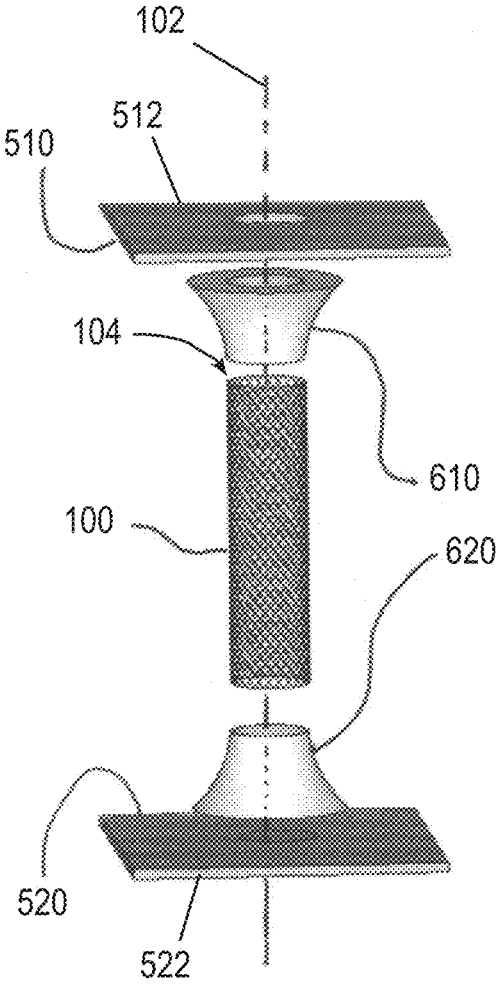
FIG. 6 is an expanded perspective view illustrating how the multi-axially braided reinforcement sleeve is aligned and attached to the upper and lower surfaces in one embodiment.

FIG. 6 is an expanded perspective view of the reinforcement sleeve 100 positioned between the upper surface 510 and lower surface 520, including the flared portion of the reinforcement sleeve 610 and a lower flared portion of the reinforcement sleeve 620 in the form of a concave flaring cone shape at the respective connections with the upper surface 510 and the lower surface 520.

In some methods, a pipe such as a PVC pipe (not shown) can be inserted into the central opening 104. The outer diameter of the PVC pipe fits within the central opening 104 and preferably is adjacent to the inner diameter of the installed reinforcement sleeve 100. Thus, the PVC pipe or a tremie would be nested inside the reinforcement sleeve 100, and the cylindrical structure of the PVC pipe holds the reinforcement sleeve in place while the concrete is being poured and then is removed.

Figure 7:
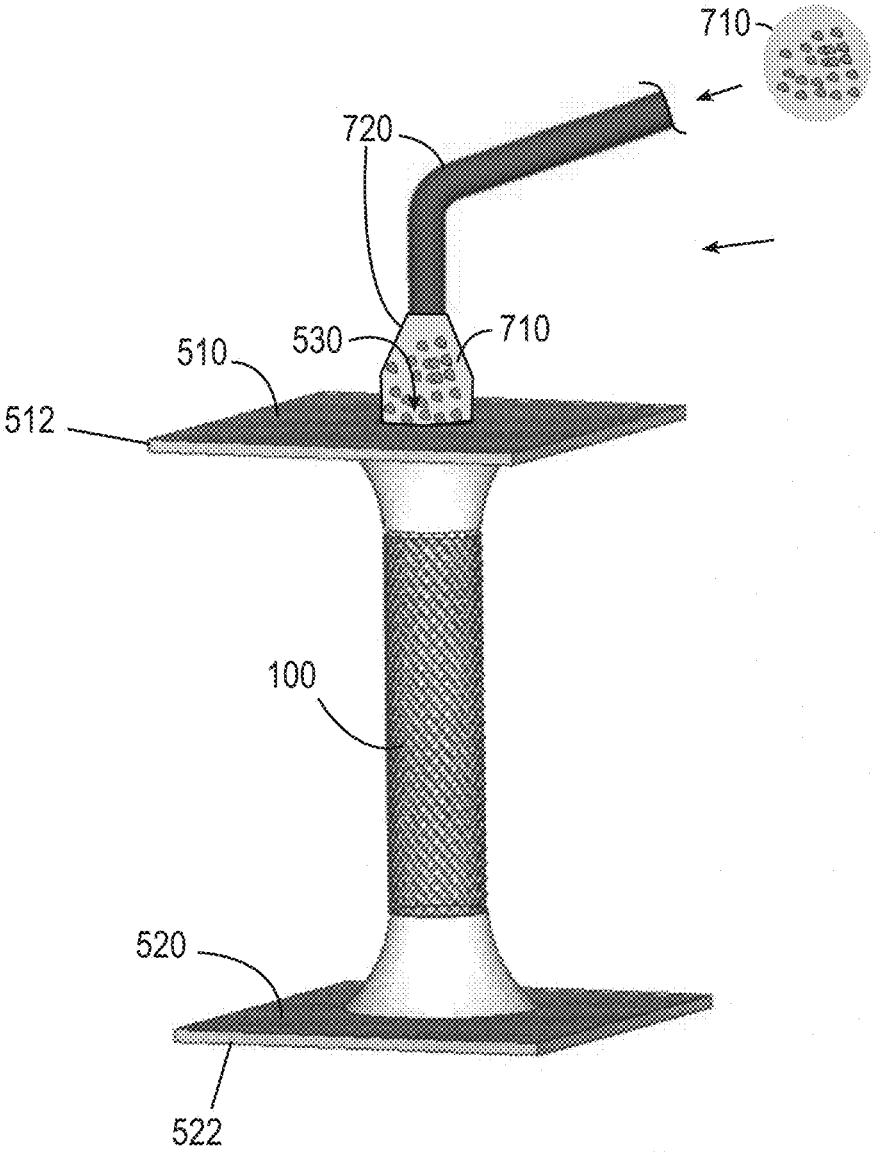
FIG. 7 is a perspective view of concrete being poured through a tube into the central opening of the reinforcement sleeve.

FIG. 7 is a perspective view of concrete 710 being poured via a delivery tube 720 and through the opening 530 in the upper surface 510 into the central opening of the reinforcement sleeve 100. Generally, the concrete is poured into the central opening 104 until it is filled.

In the embodiment of FIGS. 5, 6, and 7, an opening 530 in the upper surface 510 is provided to allow the concrete 710 to be poured through and into the central opening 100 as is done with conventional formwork. Generally, the central opening 104 of the multi-axially braided reinforcement sleeve 100 must be accessible in some manner, so that the concrete 710 can be poured in. If in an alternative embodiment there are circumstances where the opening 530 at the top of the column is not available, spreaders could be used to create an opening in the side of the reinforcement sleeve 100 through which concrete can be poured and the spreaders removed and the sleeve 100 reassembled or mended.

In the embodiment where the PVC pipe is utilized to maintain the columnar structure while the concrete is being poured, the PVC pipe within the opening is first filled with concrete. Then, the PVC pipe is removed, more concrete is added to fill the space vacated by the PVC pipe, and to fill the opening, and the concrete is allowed to flow to the reinforcement sleeve.

Figure 8A:
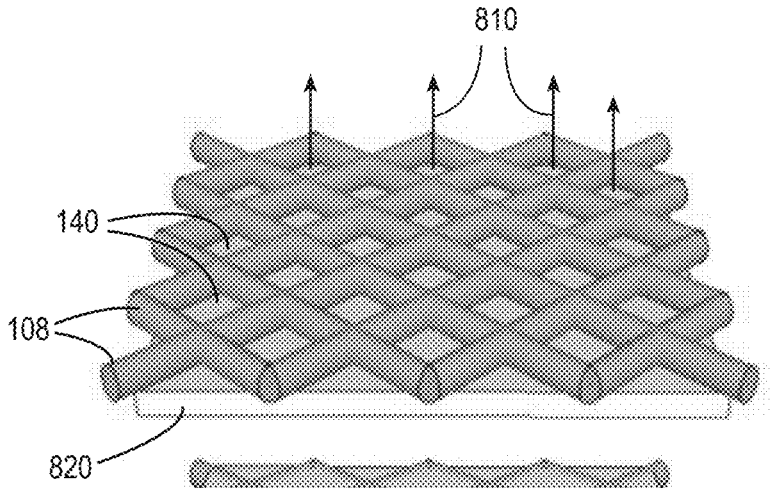
FIGS. 8A, 8B, and 8C are close-up perspective views of a section of the outside of the BMASS support element during and after construction.
Figure 8B:
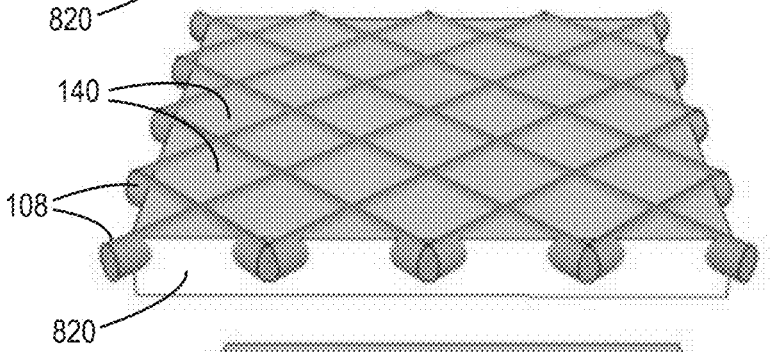
Figure 8C:
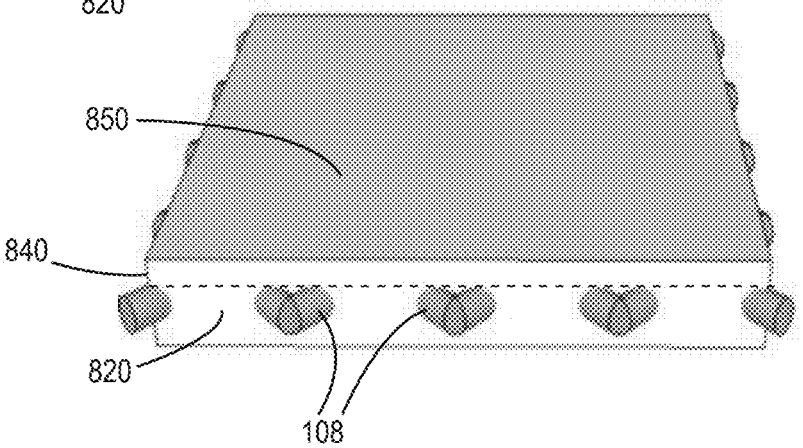

FIGS. 8A, 8B, and 8C are close-up perspective cut-out views of sections of the outside of the column, illustrating the flow of concrete through the multi-axially braided reinforcement sleeve 100 during construction. A similar flow goes through an inner sleeve which will be described later with reference to FIG. 14 et seq.

FIG. 8A is a section 801 that illustrates a beginning flow 810 of cement paste 820 out through the gaps 140 between the strands 108 in the reinforcement sleeve. FIG. 8B is a section 802 after the concrete paste 820 has flowed into the gaps 140, and substantially covers the strands 108. At this point, the strands 108 have become substantially embedded within the concrete paste 820. In some embodiments, the cement paste 820 can now be allowed to dry.

In other embodiments, as shown in FIG. 8C, the concrete paste 820 can flow out farther from the gaps 140, to create an additional covering for the reinforcement sleeve, which can be smoothed to provide a cleaner appearance. FIG. 8C shows section 803 of a concrete outer layer 840 that is formed after the cement paste 820 has flowed through the gaps and dries outside the strands 108 of the sleeve. As discussed above, the reinforcement sleeve 100 defines gaps 140 that may or may not be large enough to allow a flow of the semi-liquid cement paste and small particles such as sand, but small enough to prevent the outward flow of coarse aggregate (e.g., gravel, rocks). As the semi-liquid cement paste 820 flows through the gaps 140, it reaches the outer surface of the reinforcement sleeve, forms the outer layer 840, and then dries enough to be spread by workers into a smooth outer surface 850.

Figure 9:
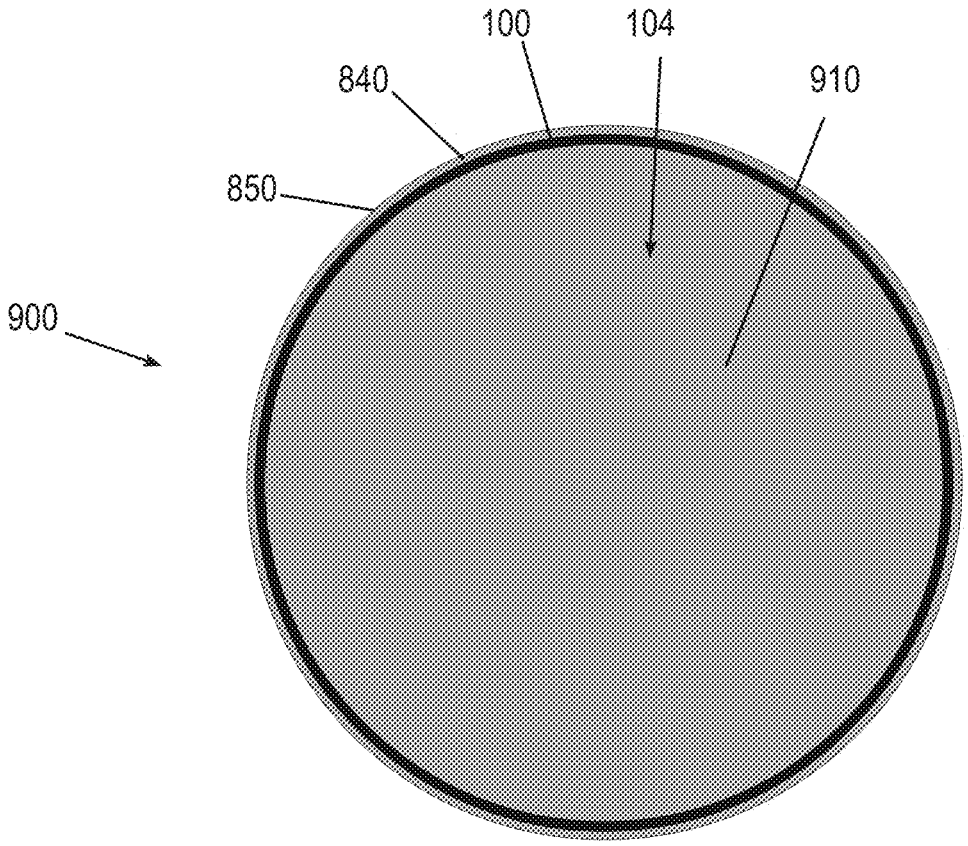
FIG. 9 is a cross-sectional view of a completed single-sleeve BMASS support element including the multi-axially braided reinforcement sleeve, including a concrete core and a concrete layer outside.

FIG. 9 is a cross-sectional view of one embodiment of a completed column 900 such as column 1000 (FIG. 10) or column 1100 (FIG. 11). The central opening of the reinforcement sleeve (104, FIG. 1) is now filled with concrete, including coarse aggregate and cement paste, that provides a concrete core 910. The reinforcement sleeve 100 is now embedded in concrete around the outside perimeter of the concrete core 910.

FIG. 9 also illustrates an embodiment that includes the outer smoothed surface 850 of the column, and adjacent to the surface 850, the outer layer 840 of dried cement paste and small particles enclose the reinforcement sleeve 100.

As shown in FIG. 9, the multi-axially braided reinforcement sleeve 100 contains the concrete within the core 910 and supports the column 900 transversely. Yet during extreme earthquake events, the reinforcement sleeve 100 doesn't go under compression and therefore does not expand to cause any damage to the column. Instead, if the column drifts due to earthquake forces, the reinforcement sleeve may elongate and tighten around the column whenever the column needs lateral support.

Figure 10:
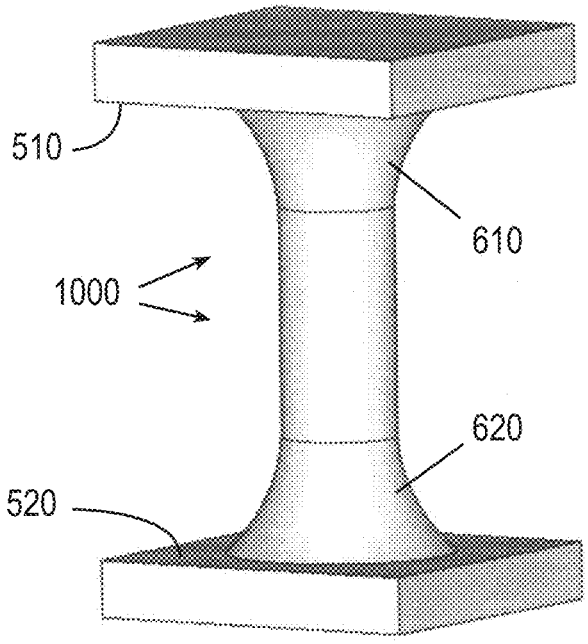
FIG. 10 is a perspective view of a finished column after the outside surface has been smoothed.
Figure 11:
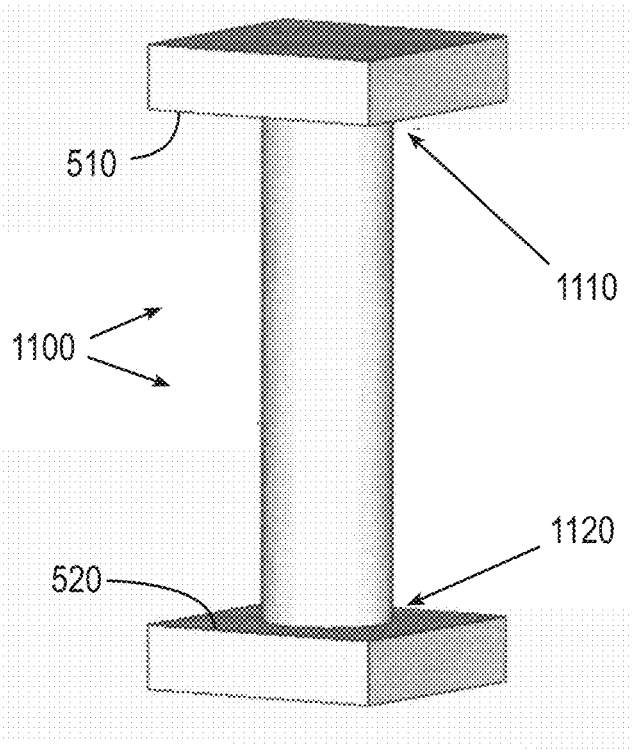
FIG. 11 is a perspective view of a finished column in an alternative implementation in which a straight cylindrical joint support is utilized.

FIG. 10 is a perspective view of one embodiment of a finished column 1000 after the outside surface has been smoothed including the concave section. In this embodiment, upper flared portion of the reinforcement sleeve 610 and the lower flared portion of the reinforcement sleeve 620 have the form of a concave flaring cone shape at their respective connections with the upper surface 510 and the lower surface 520.

FIG. 11 is a perspective view of another embodiment of a finished column 1100 in which a straight cylindrical joint support configuration is used for the upper joint 1110 and a lower joint 1120, instead of the concave flared cone configuration shown in the embodiment of FIG. 10.

Implementations are described herein that utilize the BMASS support element as a column, such as the column 1000 or column 1100, or as a beam such as will be described in more detail, e.g., with reference to FIG. 20 et seq.

(5) TRIAXIAL SLEEVE EMBODIMENT

Figure 12:
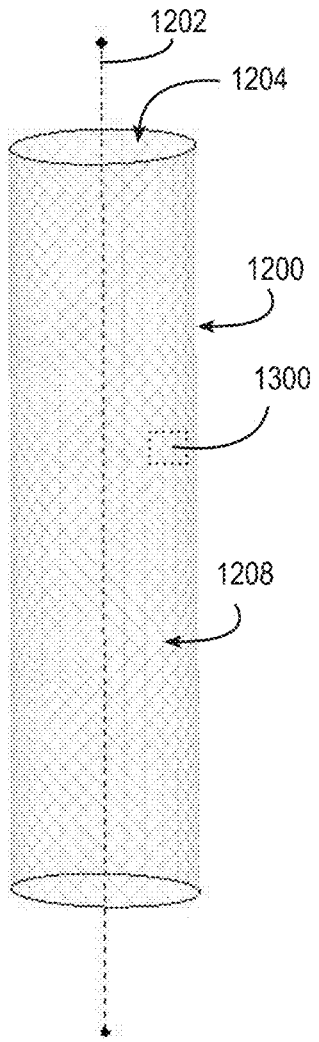
FIG. 12 is a perspective view of a triaxially-braided tubular reinforcement sleeve.

FIG. 12 is a perspective view of a triaxially-braided tubular reinforcement sleeve 1200 in an extended configuration. As shown in FIG. 12, the tubular structure of the sleeve 1200 defines a central axis 1202 and a central opening 1204, and the sleeve 1200 includes a plurality of strands 1208 weaved into a triaxial configuration around the central axis 1202.

Figure 13:
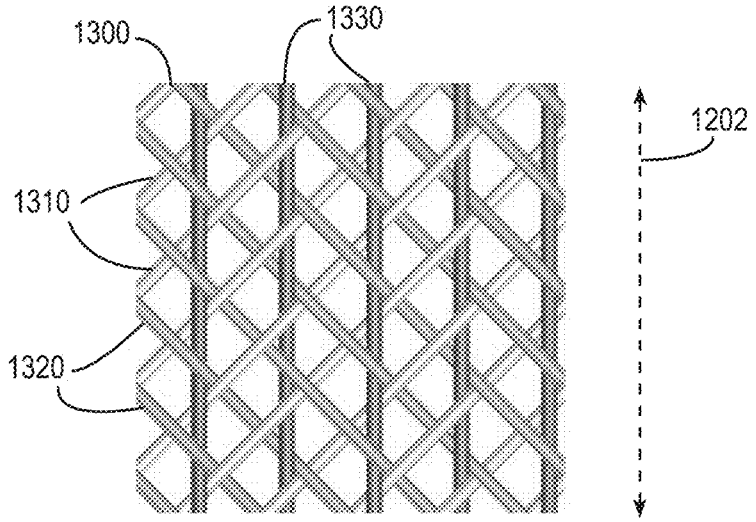
FIG. 13 is a side view of a section of the triaxially braided reinforcement sleeve, illustrating a triaxial weave.

FIG. 13 is a side view of a cut-out section 1300 of the triaxially braided reinforcement sleeve 1200, illustrating the triaxial weave. As can be seen from this section 1300, the plurality of strands 1208 includes a first plurality of strands 1310 crossed by a second plurality of strands 1320, (similar to the biaxial weave) and in addition, the strands 1208 include a third plurality of strands 1330 aligned substantially parallel to the central axis 1202.

(6) INNER AND OUTER REINFORCEMENT SLEEVES

Figure 14:
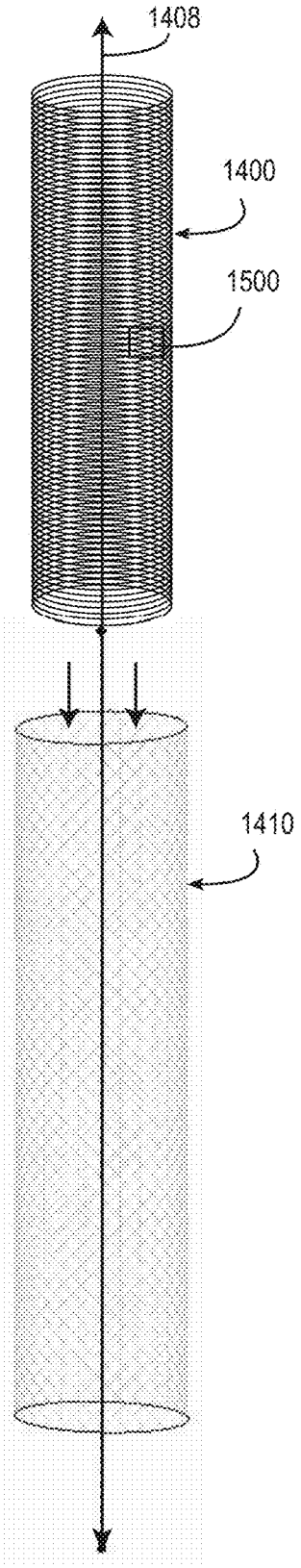
FIG. 14 is a perspective view of an inner reinforcement sleeve and an outer reinforcement sleeve, which can be implemented into a BMASS support element.

FIG. 14 is a perspective view of a sleeve arrangement that includes an inner reinforcement sleeve 1400 and an outer reinforcement sleeve 1410. The inner sleeve 1400 has a size to fit concentrically within an outer sleeve 1410. The inner reinforcement sleeve 1400 has a plurality of strands that are oriented in a substantially lateral direction (i.e., the strands wrap laterally or transverse to a central axis 1408 defined by the inner and outer sleeves. The outer sleeve 1410 comprises a multi-axially braided sleeve such as the triaxially-braided sleeve 1200 or the biaxially-braided sleeve 100.

Figure 15:
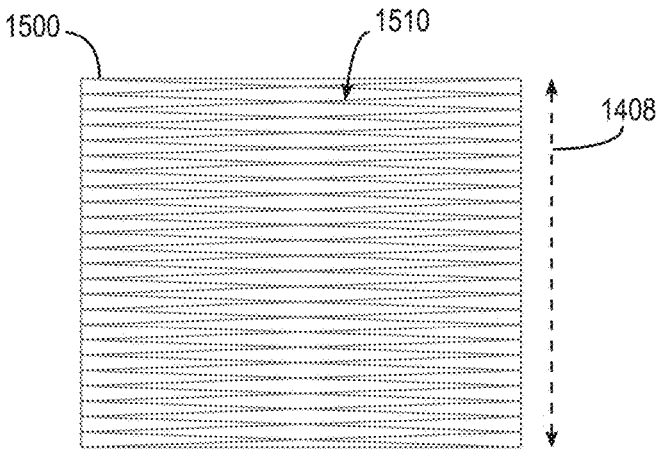
FIG. 15 is a side view of a section of the inner reinforcement sleeve, illustrating a substantially horizontal weave.

The inner reinforcement sleeve 1400 may be manufactured in a tubular configuration as shown in FIG. 15. In alternative embodiments, the inner reinforcement sleeve 1400 can be formed by wrapping a sheet of unidirectional material so that the direction of the material's strength is substantially lateral to the central axis. The inner reinforcement sleeve 1400 concentrically fits within the outer reinforcement sleeve 1410. In some embodiments. the inner and outer reinforcement sleeves may be connected by any suitable means.

FIG. 15 is a side view of a cut-out section 1500 of the inner reinforcement sleeve 1400, illustrating a substantially lateral weave 1510 in one embodiment. Generally, the substantially lateral to the central axis weave may be provided in any suitable configuration such as a biaxial weave with very small-angle crossings, a spiral, or hoops with longitudinal connections, or any other weave that provides substantial strength in the transverse direction.

Figure 16:
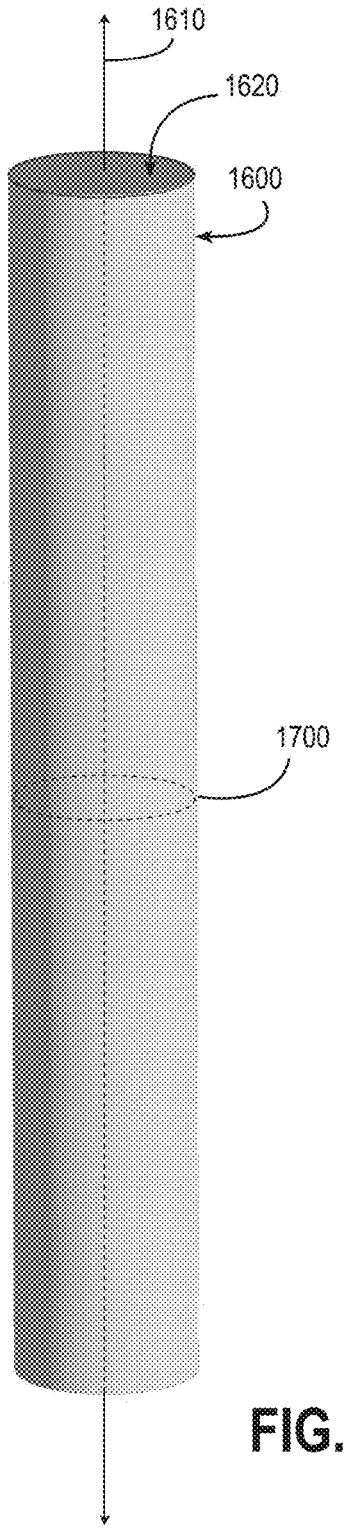
FIG. 16 is a perspective view of a completed column that includes an inner sleeve and an outer sleeve to reinforce the column.

FIG. 16 is a perspective view of a completed BMASS support element 1600, which has a cylindrical shape that defines a central axis 1610 and a central core 1620. As illustrated by the cross-section 1700 shown in FIG. 17, BMASS support element 1600 includes the inner reinforcement sleeve 1400, and the outer reinforcement sleeve 1410 around its perimeter.

Figure 17:
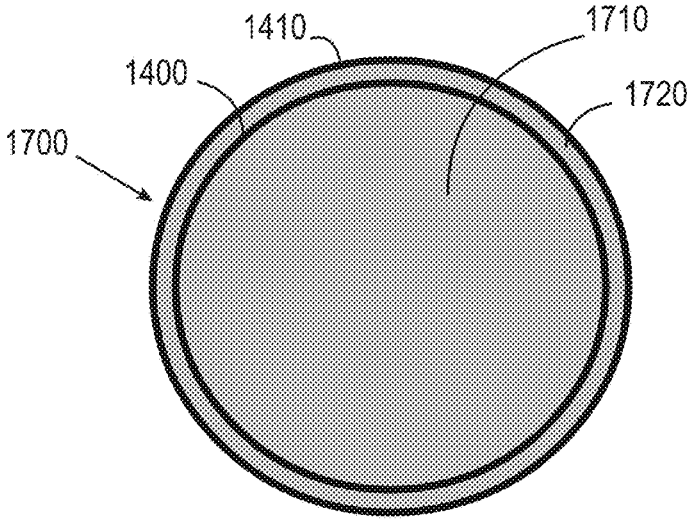
FIG. 17 is a cross-sectional view of one embodiment of the completed BMASS support element that includes an inner sleeve and an outer sleeve embedded in concrete along the column perimeter.

FIG. 17 is a cross-sectional view of one embodiment of a completed BMASS support element 1600 including the inner reinforcement sleeve 1400 and the outer reinforcement sleeve 1410 embedded in the BMASS support element 1600. The central core 1620 is now filled with concrete, including coarse aggregate and cement paste, that provides a concrete core 1710 within the reinforcement sleeves consisting essentially of concrete. The outer reinforcement sleeve 1410 is now embedded in concrete on the outside perimeter of the concrete core 1710, and the inner reinforcement sleeve 1400 is situated concentrically within the outer sleeve 1410.

In the FIG. 17 embodiment, the concrete has flowed through the inner reinforcement sleeve 1400 and into the outer reinforcement sleeve 1410, so that both the inner and outer reinforcement sleeves are embedded in the concrete. For purposes of illustration, the inner and outer reinforcement sleeves are shown separated by a middle concrete layer 1720. In some embodiments, the inner and outer reinforcement sleeves may be adjacent to each other and in those embodiments, the middle concrete layer 1720 may be small or non-existent. In FIG. 17, the outer reinforcement sleeve 1410 is shown embedded in the concrete, but unlike the BMASS support element shown in FIG. 9, FIG. 17 does not illustrate the smooth outer layer 840 of dried cement paste and small particles. For some implementations, the smooth outer concrete layer 840 may not be desired or needed. However, other implementations of BMASS support element 1600 may utilize the outer cement layer 840 to enclose the outer reinforcement sleeve 1410 and provide a substantially smooth outer surface.

Figure 18:
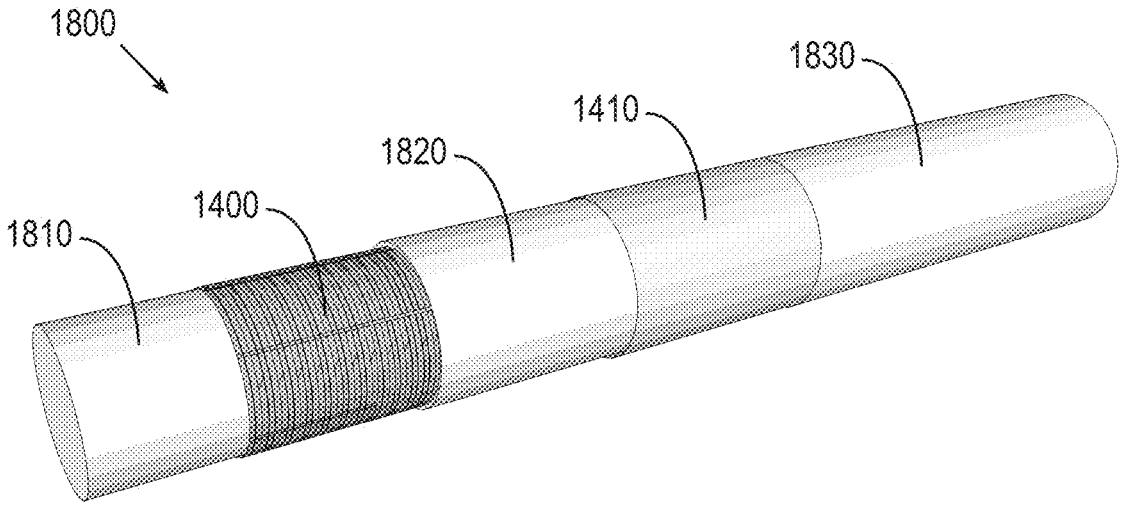
FIG. 18 is a perspective, cut-away view of an embodiment of a completed BMASS support element including the inner reinforcement sleeve and the outer reinforcement sleeve embedded in the completed BMASS support element.

FIG. 18 is a perspective, cut-away view of an embodiment of a completed BMASS support element 1800 including the inner reinforcement sleeve 1400 and the outer reinforcement sleeve 1410 embedded in the completed BMASS support element 1800. The concrete core 1810 is formed within the reinforcement sleeves, consisting essentially of concrete. In the FIG. 18 embodiment, the concrete has flowed through the inner reinforcement sleeve 1400 and into the outer reinforcement sleeve 1410, so that both the inner and outer reinforcement sleeves are embedded in the concrete, creating a middle concrete layer 1820 between the reinforcement sleeves 1400, 1410. After the concrete paste has flowed out through the outer reinforcement sleeve 1410 and cured sufficiently, it is smoothed to create a smooth outer concrete layer 1830, which encloses the outer reinforcement sleeve 1410 and provides a substantially smooth outer surface. The outer reinforcement sleeve 1410 is now embedded in concrete on the outside perimeter, and the inner reinforcement sleeve 1400 is situated concentrically within the outer sleeve 1410.

As shown in FIGS. 17 and 18, the inner and outer reinforcement sleeves work together to contain the concrete within the core 160 and support BMASS support element transversely. Yet during extreme earthquake events, the inner and outer reinforcement sleeves do not go under compression and therefore do not expand to cause any damage to the BMASS support element. Instead, if the BMASS support element drifts due to earthquake forces, the reinforcement sleeves may elongate and even tighten around the BMASS support element whenever the BMASS support element needs lateral support.

As an alternative construction technique, rather than forming the concrete BMASS support element in place, the BMASS support element could be formed elsewhere and then transported to the installation. For example, the BMASS support element could be formed on the job site or in a nearby location, and then lifted into position to be installed. The BMASS support elements could be pultruded through dies while using a concrete pump to force the concrete into the core of the sleeves. Once cured, the BMASS element can be cut to length. Pultrusion is a continuous process for manufacture with an approximate constant cross-section by pulling the material, as opposed to extrusion which pushes the material.

Figure 19:
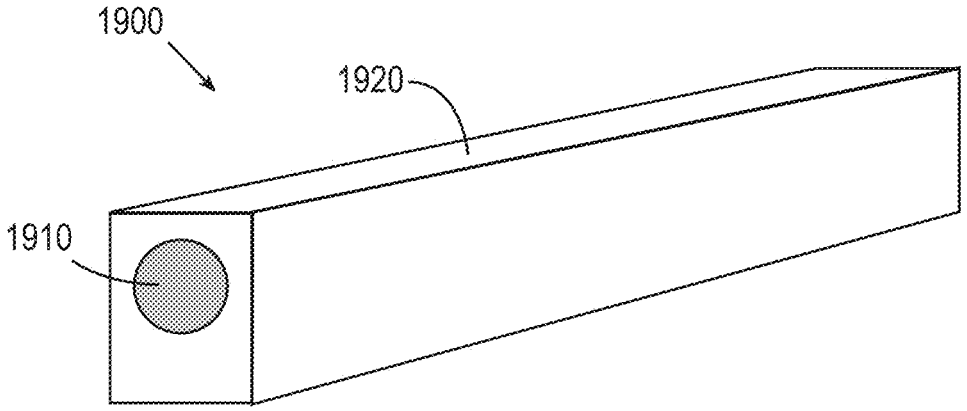
FIG. 19 is a perspective view of an alternative configuration of a structural support element in which a cylindrical BMASS element is integrated into a rectangular box structure

FIG. 19 is a perspective view of an alternative configuration of a structural support element 1900 in which a cylindrical BMASS element 1910 is integrated into a rectangular box structure 1920. The BMASS element 1900 itself is cylindrical, which provides a very strong structural configuration and provides significant strength to the rectangular box, which may, for example be formed of concrete. FIG. 19 illustrates that the BMASS element 1910 can be integrated into various structures, in a variety of different configurations, to provide strength and resiliency against damage. Depending upon the application, multiple BMASS elements may integrated into a structure.

In many embodiments, the step of installing rebar axially along the length of the BMASS support element may be eliminated entirely to save cost and also to prevent destruction during an earthquake. However, for some purposes, rebar may still be useful. For example, a length of rebar can be installed extending into either or both ends of the BMASS support element to prevent the ends of the BMASS support elements from sliding or provide additional structural support depending on the demands placed on the BMASS support element.

(7) CABLE SUPPORT STRUCTURAL ASSEMBLIES USING BMASS SUPPORT ELEMENT

A number of different embodiments of the cable-supported structural assembly are described herein, using the flexible, reinforced concrete BMASS support element.

(8) SINGLE CABLE BMASS BEAM ASSEMBLY

Figure 20:
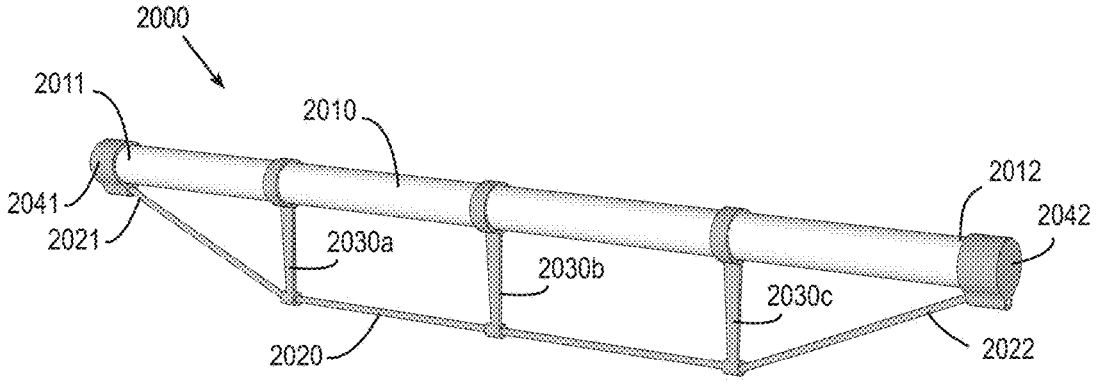
FIG. 20 is a perspective view of one embodiment of a cable-supported BMASS beam assembly.

FIG. 20 is a perspective view of one embodiment of a cable-supported BMASS beam assembly 2000. The BMASS beam assembly 2000 includes a cylindrical BMASS element 2010 that defines a first end 2011 and a second end 2012. A first end cap 2041 is situated on the first end 2011, and a second end cap 2042 is connected to a cable 2020. Particularly, the cable 2020 has a first end 2021 connected to the first end cap 2041, and a second end 2022 connected to the second end cap 2042 on the BMASS element. The cable 2020 may be made of metal, fiber, or any suitable material, with a strength designed to meet load requirements. Stainless steel is one preferred material for the cable.

One or more braces 2030 are positioned between the cable 2020 and the BMASS element 2010 to hold the cable 2020, transfer force from the cable 2020 to the BMASS element 2010, and generally provide support for the beam assembly 2000. In this embodiment, three braces 2030 are provided, including a first brace 2030*a*, a second brace 2030*b*, and a third brace 2030*c*; in other embodiments, another number of braces 2030 may be provided.

Figure 21:
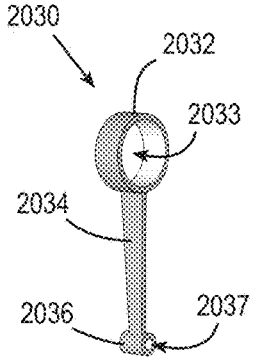
Figure 38:
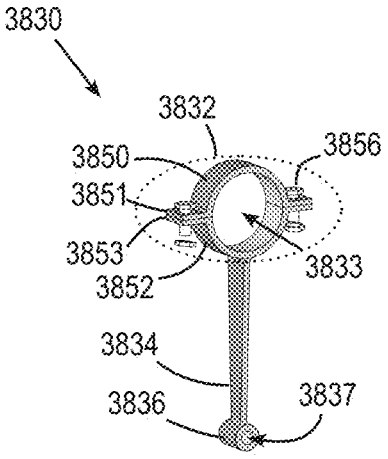
FIG. 38 is a perspective view of an alternative embodiment of a support arm in which the collar includes a clamp that attaches to the BMASS element.

FIG. 21 is a perspective view of one of the braces 2030. Each of the braces 2030 includes a collar 2032, a support arm 2034, and a cable pass-through 2036. The collar defines an interior cylindrical opening 2033 having a size that fits around the cylindrical outer surface of the BMASS element 2010. The collar 2032 may be a single unit as shown in FIG. 21, or it may be in a clamp form that fits around BMASS element 2010, and then is affixed with bolts, for example, such as shown in FIG. 38.

The brace also includes the pass-through 2036 that has an opening 2037 through which the cable 2020 can pass. The cable 2020 is slidable within the pass-through openings 2037.

Figure 22:
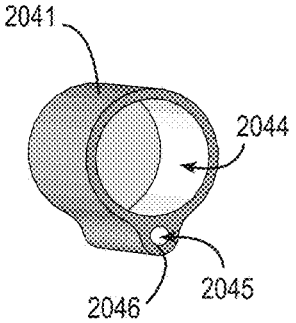
FIG. 22 is a perspective view of the end cap of the BMASS beam assembly, viewed from the inside.
Figure 23:
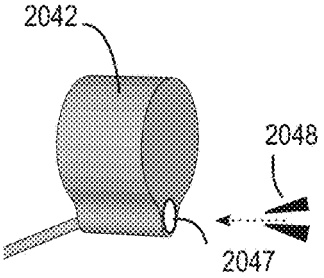
FIG. 23 is a perspective view of the end cap of the BMASS beam assembly, viewed from the outside.

FIGS. 22 and 23 show two different perspective views of the end caps 2041, 2042. The end caps 2041, 2042 each define an inner cylindrical aperture 2044, connected to the respective ends 2011, 2012 of the BMASS element 2010. The end caps 2041, 2042 include a cable holding mechanism, which in this embodiment includes a tapered aperture 2045 having an insertion end 2046 with a size to insert the cable ends, and a larger end 2047. The insertion end 2046 faces the inside of the assembly, and the larger end 2047 faces in the opposite direction, outside the assembly. To hold the cable in place, wedges 2048 may be inserted into the larger end 2047 of the tapered aperture 2045. The cable 2020 may be tensioned at one or both ends, using a conventional technique such as a hydraulic ram or post tension stressing jack, while at the same time pushing the wedges 2048 into a locking position in the tapered aperture 2045.

(9) EXAMPLE OF BMASS BEAM ASSEMBLY INSTALLED IN STRUCTURE

Figure 24:
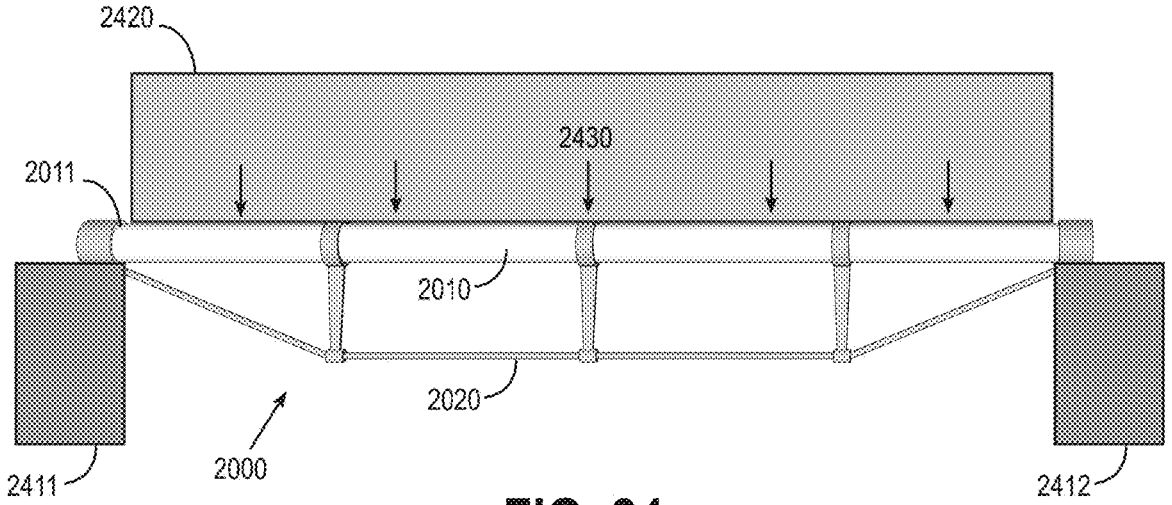
FIG. 24 is a side view of the BMASS beam assembly installed into a structure, illustrating load forces.

FIG. 24 is a side view of the BMASS beam assembly 2000 installed in a structure, which may be a bridge, building or any other structure. Each end of the BMASS beam assembly 2000 rests upon a side support; particularly, the first end 2011 (including the first end cap 2041) rests upon a first side support 2411, and the second end 2012 (including the second end cap 2042) rests upon a second side support 2412. The side supports 2411, 2412 may be a part of a variety of structures, for example, either side of a bridge, columns in a structure, or other beams. The side supports may be formed with to include a notch shaped to receive the respective ends of the BMASS beam assembly. A load 2420, which may, for example, be a bridge, road surface. or the floor of a building, exerts downward forces all along the adjacent surface of the BMASS element, as illustrated by arrows 2430. Generally, the side supports must be strong enough the hold against the forces exerted by the load 2420 on the BMASS beam assembly.

Installed, the BMASS element 2010 provides compressive strength, and the cable provides tensile strength to the BMASS beam assembly 2000. As will be described, the cable 2020 can be tensioned to provide curvature to the BMASS element 2010, which provides greater strength and resiliency to the BMASS beam assembly.

(10) CURVATURE ADJUSTMENT

[Ray: needs review: Cable applies force to ends along vector that has axial and transverse components.]

Figure 25:
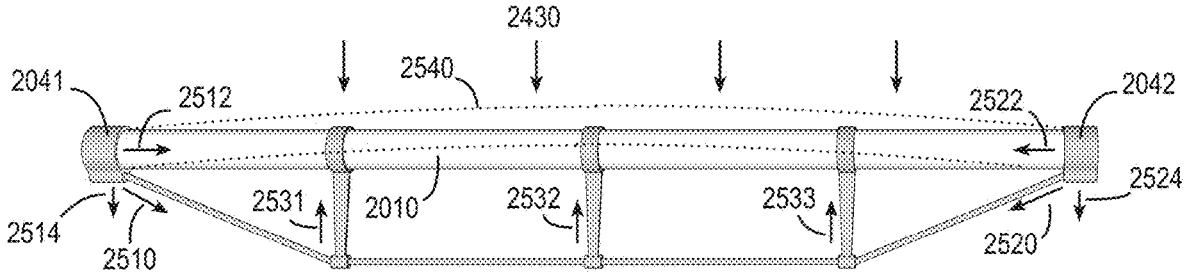
FIG. 25 is a side view of the BMASS beam assembly, illustrating the effect of tensioning of the cable, and the resulting curvature of the BMASS element.

FIG. 25 is a side view of the BMASS beam assembly 2000 under load forces 2430, illustrating the effect of tensioning of the cable 2020, and the resulting curvature of the BMASS element 2010 to counter against the load forces 2030.

Tensioning the cable 2020 creates force vectors at an angle from the end caps, which can be divided into axial and transverse vectors: particularly, from the first end cap 2410 a first force vector 2510 resolves into a first axial vector 2512 and a first transverse vector 2514, and from the second end cap 2420 a second force vector 2520 resolves into a second axial vector 2522 and a second transverse vector 2524.

It may be noted that the first and second axial vectors 2512, 2522 provide opposing forces, which advantageously places the BMASS element 2010 under compression. Furthermore, the first and second transverse vectors 2514, 2524 create downward forces, in a vertical direction respectively from each of the end cap 2041, 2042, which transfers gravitational forces to the ground.

Tensioning the cable 2020 also creates upward force vectors 2531, 2532, 2533 in each of the braces 2030, which are transmitted upward from the cable 2020 through each of the braces 2030, to the BMASS element 2010.

The net result of the tensioning forces in the cable, is that the axial vectors place the BMASS element under compression and prevents tensile forces from forming, cracking, and shearing the beam. Furthermore, the downward force of the transverse vectors at the BMASS element ends, combined with the upward force from the brace vectors in the middle of the BMASS element, create a curvature 2540, shown in dotted lines. By selecting the amount of tension applied to the cable, and positioning the braces along the BMASS element at determined locations, and selecting length of the brace arms 2034, and other design considerations, the amount of curvature can be controlled, and help to support the load.

Also, the cable 2020, via the braces 2030, applies sideways force to the BMASS element 2010. Advantageously, the flexible sleeves in the BMASS element (see FIG. 18 for example), allow flexing of the BMASS element without failure.

(11) DUAL CABLE BMASS BEAM ASSEMBLY

Figure 26:
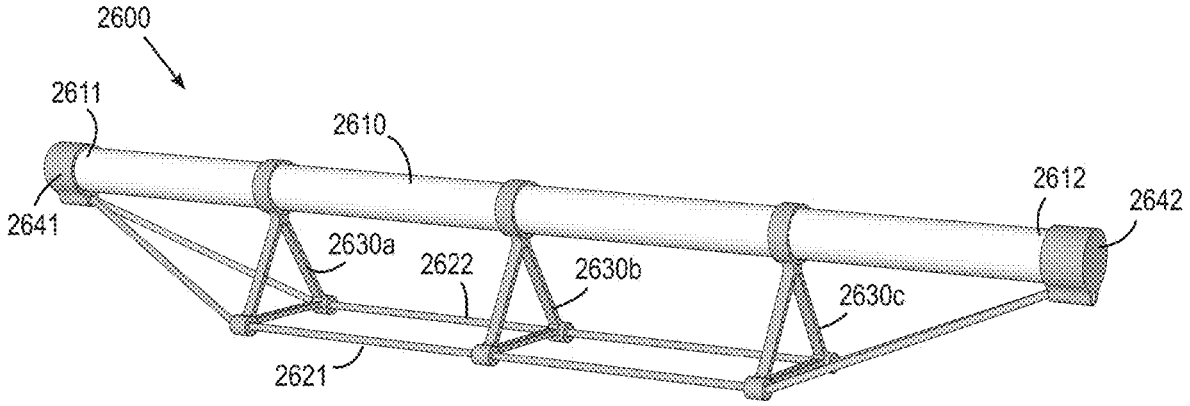
FIG. 26 is a perspective view of a dual-cable embodiment of a cable-supported BMASS beam assembly.

FIG. 26 is a perspective view of a dual-cable embodiment of a cable-supported BMASS beam assembly 2600. FIG. 26 is an example of BMASS beam assemblies that utilize multiple cables; in other embodiments additional cables may be added. One advantage of the multiple cable configuration is that it allows curvature adjustments from multiple angles, which can be useful in some implementations.

The BMASS beam assembly 2600 includes a cylindrical BMASS element 2610 that defines a first end 2611 and a second end 2612. A first end cap 2641 is situated on the first end 2611, and a second end cap 2642 is connected to two cables including a first cable 2621 and a second cable 2622. Particularly, each of the cables 2621, 2622 have a first end connected to the first end cap 2641, and a second end connected to the second end cap 2642. The cables 2621, 2622 may be made of metal, fiber, or any suitable material, with a strength designed to meet load requirements. Stainless steel is one preferred material for the cable.

One or more triangular braces 2630 are positioned between the cables 2621, 2622 and the BMASS element 2610 to hold the cable 2621, 2622, transfer force from the cables to the BMASS element 2610, and generally provide support for the beam assembly 2600. In this embodiment, three triangular braces 2630 are provided, including a first brace 2630*a*, a second brace 2630*b*, and a third brace 2630*c*; in other embodiments, a different number of braces 2630 may be provided.

Figure 27:
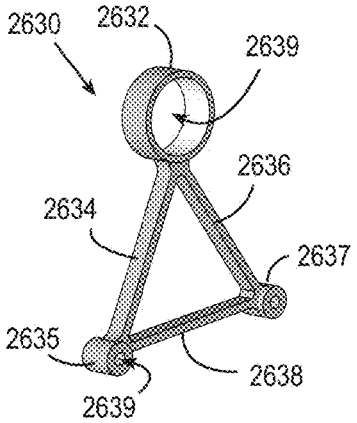
FIG. 27 is a perspective view of an embodiment of a triangular brace.

FIG. 27 is a perspective view of one embodiment of the triangular braces 2630. Each of the triangular braces 2630 includes a collar 2632, a triangular support structure including a first support arm 2634 connected between the collar 2632 and a first pass-through 2635, a second support arm 2636 connected between the collar 2632 and a second pass-through 2637, and a connecting arm 2638 connected between the first pass-through 2635 and the second pass-through 2637. In other words, the triangular support structure defines three vertices, the first vertex is connected to the collar 2632, the second vertex is connected to the first pass-through 2635, and the third vertex is connected to the second pass-through 2637.

The collar 2632 defines an interior cylindrical opening 2639 having a size that fits around the cylindrical outer surface of the BMASS element 2610. The collar 2632 may be a single unit as shown, or it may be in a clamp form that fits around BMASS element 2610, and then may be affixed with bolts or any suitable connection, such as shown in FIG. 38.

The pass-throughs 2635, 2637 each have an opening 2639 through which the first and second cables 2621, 2622 can pass respectively. The cables 2621, 2622 are slidable within the pass-through the openings 2639.

Figure 28:
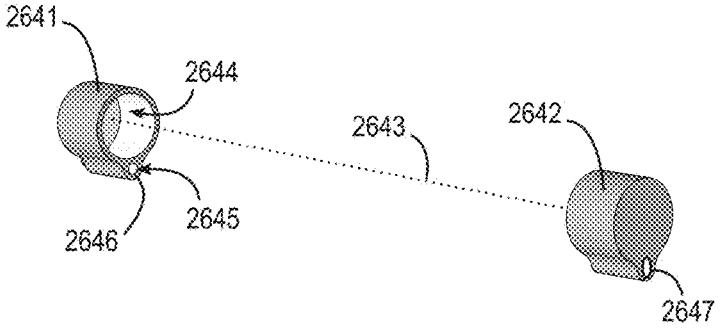
FIG. 28 is a perspective view that shows end caps arranged along an axis defined by the BMASS element.

FIG. 28 is a perspective view that shows two the two end caps 2641, 2642, arranged along an axis 2643 defined by the BMASS element 2610. The end caps 2641, 2642 each define an inner cylindrical aperture 2644, connected to the respective ends 2611, 2612 of the BMASS element 2610. The end caps 2641, 2642 include a cable holding mechanism, which in this embodiment includes a tapered aperture 2645 having an insertion end 2646 with a size to insert the cable ends, and a larger end 2647. The insertion end 2646 faces the inside of the assembly, and the larger end 2647 faces in the opposite direction, outside the assembly. To hold the cable in place, wedges may be inserted into the larger end 2647 of the tapered aperture. The cables may be tensioned at one or both ends, using conventional techniques such as a hydraulic ram or post tension stressing jack, while at the same time pushing the wedges into a locking position in the tapered aperture 2645.

(12) CABLE SUPPORTED COLUMN

Figure 29:
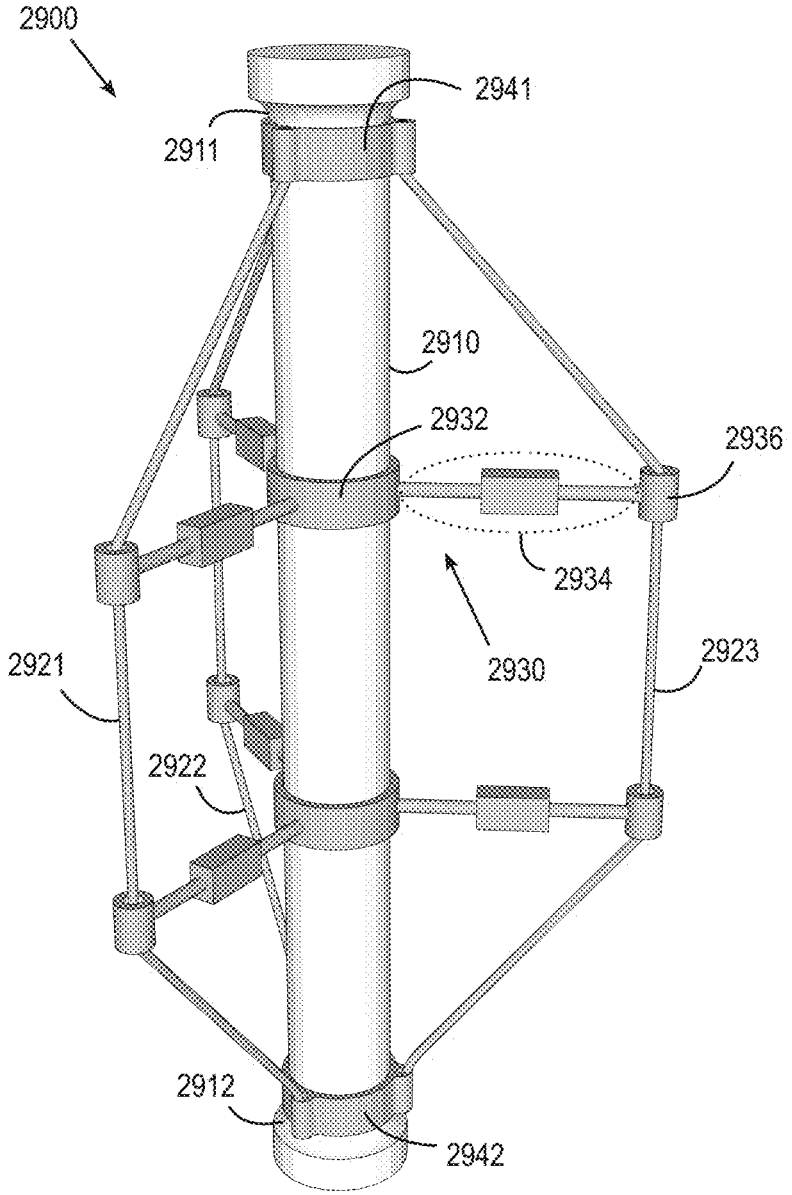
FIG. 29 is a perspective view of a cable-supported BMASS column assembly.

FIG. 29 is a perspective view of a cable-supported BMASS column assembly 2900. The BMASS column assembly 2900 includes a cylindrical BMASS element 2910 that defines a first end 2911 and a second end 2912. A first end collar 2941 is situated proximate to the first end 2911, and a second end collar 2942 is connected proximate to the second end 2912. Three cables, including a first cable 2921, a second cable 2922, and a third cable 2923 are connected between the first and second end collars; particularly, each of the cables 2921, 2922, 2923 have a first end connected to the first end collar 2941, and a second end connected to the second end collar 2942. The cables 2921, 2922, 2923 may be made of metal, fiber, or any suitable material, with a strength designed to meet load requirements. Stainless steel is one preferred material for the cables.

One or more column braces 2930 are positioned between the first and second end collars 2941, 2942.

The column braces 2930 are situated on the BMASS element 2910 to hold the cables, transfer force from the cables 2921, 2922, 2923 to the BMASS element 2910, and generally provide support for the column assembly 2900. In this embodiment, two braces 2930 are provided, in other embodiments, a different number of braces 2930 may be utilized.

Figure 30:
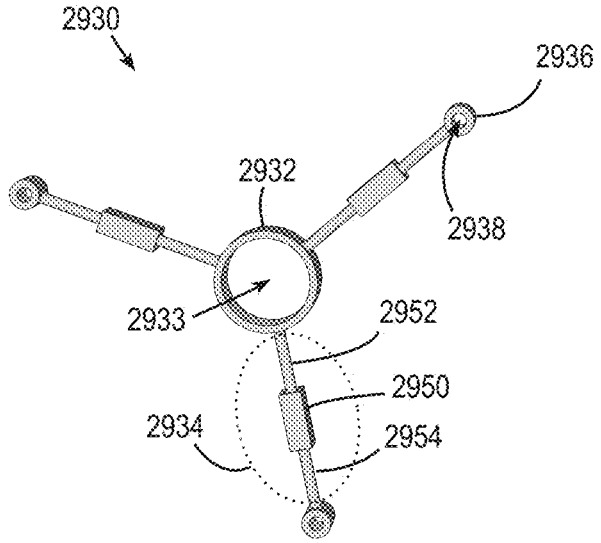
FIG. 30 is a perspective view of one of the column braces for the BMASS column assembly.

FIG. 30 is a perspective view of one of the column braces 2930. Each of the braces 2930 includes a collar 2932 that defines an interior cylindrical opening 2933 having a size that fits around the cylindrical outer surface of the BMASS element 2910. The collar 2932 may be a single unit as shown, or it may be in a clamp form that fits around BMASS element 2910, and then may be affixed with bolts or any suitable connection, such as shown in FIG. 38.

Each brace 2930 also includes a plurality of support arms 2934 extending outwardly in a spoke-like configuration from the collar 2932. The support arms 2934 may be adjustable in length, including an adjustment unit 2950 connected between a lower arm 2952 and an upper arm 2954, such as described further herein. At the distal end of each support arm 2934, a cable pass-through 2936 is provided. The pass-throughs 2936 each have an opening 2938 through which the cables can pass, respectively. The cables 2921, 2922, 2923 are slidable within the openings 2939 in the pass-throughs 2936.

Figure 31:
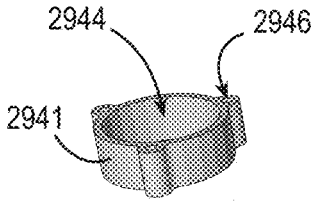
FIG. 31 is a perspective view of the end collar in a BMASS column assembly.

FIG. 31 is a perspective view of the first end collar 2941, the second end collar 2941 is similar. The end collars 2941, 2942 each define an inner cylindrical aperture 2944, connected to the respective ends 2911, 2912 of the BMASS element 2910. The end collars each include a cable holding mechanism, which in this embodiment includes a plurality of apertures 2946, spaced around the collar having a size to insert and hold the cable ends. To hold the cable in place within the apertures 2946, conventional techniques may be used. In one embodiment, the apertures 2946 may be tapered as described previously, and wedges may be inserted into the aperture 2946, on the side of the end collar opposite the inside entry point of the cables to hold the cable in place. The cables may be tensioned using a conventional hydraulic ram or post tension stressing jack.

In FIG. 29, three cables are utilized to provide transverse support in three directions from the center of the column; in other embodiments additional cables may be added. For a column, generally the structural objective is to maintain a vertical column that is as straight as possible. Using the three cables and the adjustment units 2950 for each of the cables, the tension of each cable can be selected to provide a substantially straight column. An advantage of the multiple cable configuration is that it allows adjustments from multiple angles.

(13) SMART BEAM

Figure 32:
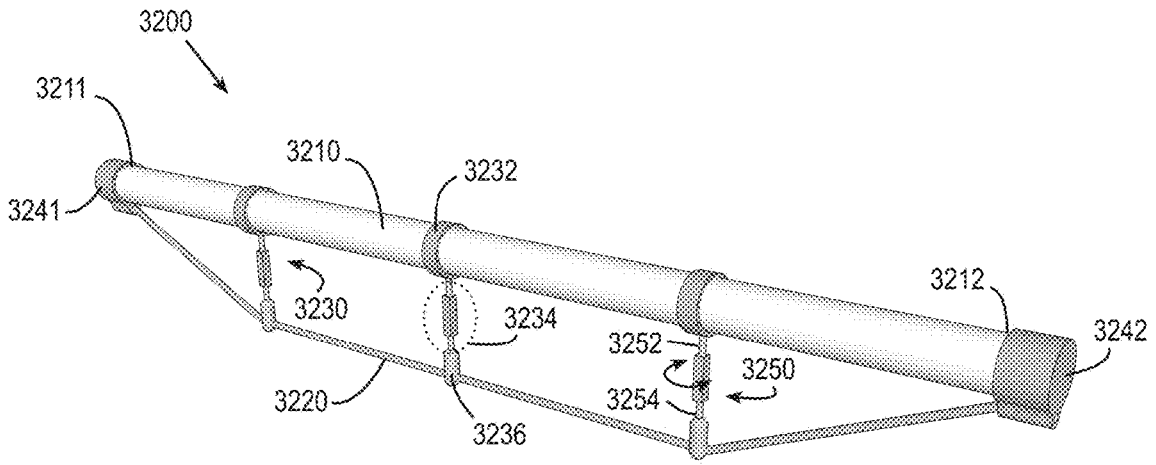
FIG. 32 is a perspective view of one embodiment of a BMASS beam assembly that includes an adjustable support arm.

FIG. 32 is a perspective view of one embodiment of a BMASS beam assembly 3200 that includes an adjustable support arm 3230, which advantageously allows the cable tension to be adjusted during and after installation. The BMASS beam assembly 3200 is similar to the BMSS beam assembly described with reference to FIGS. 20-23, except for the adjustable support arm 3230.

The BMASS beam assembly 3200 includes a cylindrical BMASS element 3210 that defines a first end 3211 and a second end 3212. First and second end caps 3241, 3242 are situated respectively on the first and second ends 3211, 3212. The cable 3220 is connected to the first end cap 3241 and the second end cap 3242 by any suitable means. The cable 3220 may be made of metal, fiber, or any suitable material, with a strength designed to meet load requirements. Stainless steel is one preferred material for the cable.

One or more braces 3230 are positioned between the cable 3220 and the BMASS element 3210 to hold the cable 3220, transfer force from the cable 3220 to the BMASS element 3210, and generally provide support for the beam assembly 3200. In this embodiment, three braces 3230 are provided, in other embodiments, another number of braces 3230 may be provided. Each of the braces 3230 includes a collar 3232, an adjustable support arm 3234, and a cable pass-through 3236.

Figure 37:
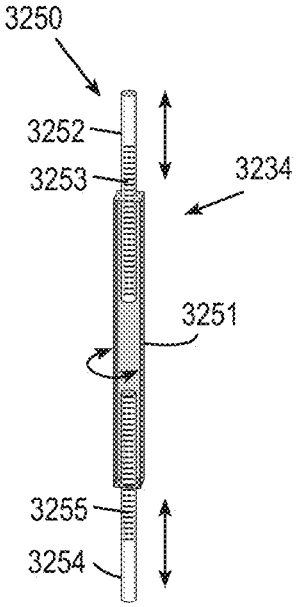
FIG. 37 is a perspective cutaway view of one example of a turnbuckle that can be implemented in a support arm.

The adjustable support arms 3234 may include a turnbuckle 3250. FIG. 37 is a perspective cutaway view of one example of a turnbuckle. The turnbuckle 3250 includes a rotatable central element 3251 connected between a first rigid arm 3252 connected to the collar 3232, and a second rigid arm 3254 connected to the pass-through 3236. The first arm 3252 includes a threaded section 3253 that engages with a corresponding section of the central element 3251, and the second arm 3254 includes a threaded section 3255 that engages with a corresponding section of the central element 3251. Thus, the turnbuckle's rotatable element 3251 may be turned to shorten or lengthen the support arm 3234, which allows manual adjustment of the cable tension and the force applied to the BMASS element 3210. The central element 3251 can be turned manually, and may include means for connecting a tool such as a wrench. For example, the central rotatable element 3251 may have parallel sides to allow a wrench to engage and rotate the element 3250. During an inspection of the tension in the cable, an inspector could easily use a wrench and turn the central nut left or right, to expand or shorten the support arm 3234.

Although typically a turnbuckle is used to create tension, in this embodiment it is utilized to create compressive forces in the support arm 3234, which translates the tension in the cable 3220 to the BMASS element 3210 via the rigid first and second arms 3252, 3254. In other words, the compressive forces in the support arm 3234 can be selected to provide strength to the structural assembly 3200 in appropriate positions on the BMASS element 3210, and make adjustments to the configuration of the BMASS element 3210, which has some flexibility. For example, adjustments can be made to add or maintain curvature, or correct distortions.

Figure 33:
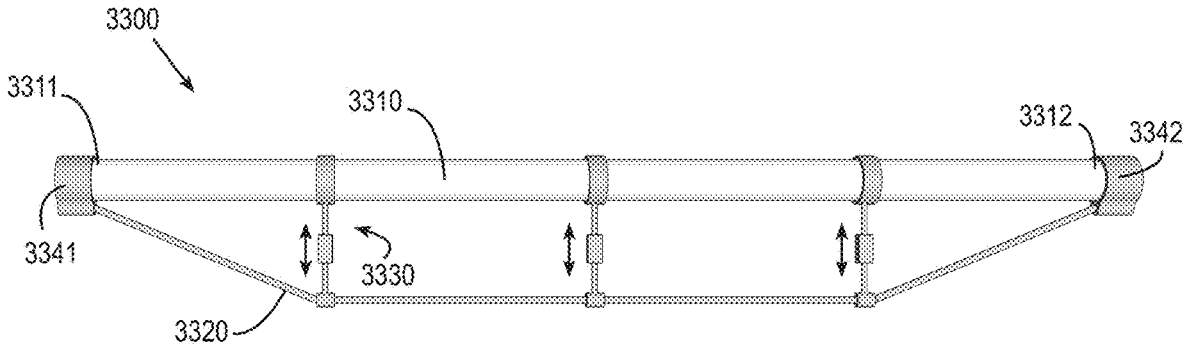
FIG. 33 is a perspective side view of another embodiment of a BMASS beam assembly that includes an adjustable support arm.

FIG. 33 is a perspective side view of another embodiment of a BMASS beam assembly 3300 that includes an adjustable support arm 3330, which advantageously allows the cable tension to be adjusted during and after installation. The BMASS beam assembly 3300 is similar to the BMSS beam assembly described with reference to FIGS. 20-23, except for the adjustable support arm 3330.

The BMASS beam assembly 3300 includes a collar that defines an interior cylindrical opening 3233 having a size that fits around the cylindrical outer surface of the BMASS element 3310 that defines a first end 3311 and a second end 3312. First and second end caps 3341, 3342 are situated respectively on the first and second ends 3311, 3312. The cable 3330 is connected to the first end cap 3341 and the second end cap 3342 by any suitable means. The cable 3330 may be made of metal, fiber, or any suitable material, with a strength designed to meet load requirements. Stainless steel is one preferred material for the cable.

One or more braces 3330 are positioned between the cable 3320 and the BMASS element 3310 to hold the cable 3320, transfer force from the cable 3320 to the BMASS element 3310, and generally provide support for the beam assembly 3300. In this embodiment, three braces 3330 are provided, in other embodiments, another number of braces 3330 may be provided. Each of the braces 3330 includes a collar 3332, an adjustable support arm 3334, and a cable pass-through 3336.

Figure 34:
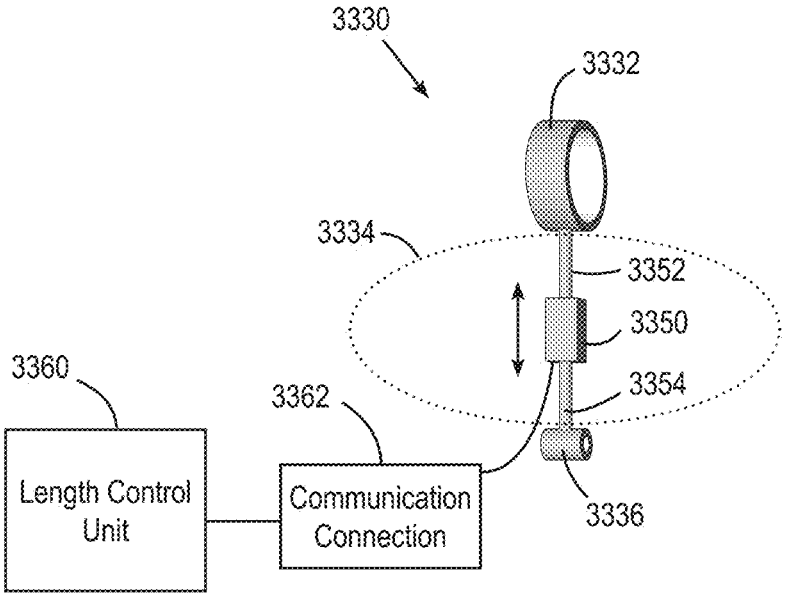
FIG. 34 is a magnified perspective view of one of the braces, including an adjustable support arm.

FIG. 34 is a magnified perspective view of one of the braces 3330. In FIG. 33, the adjustable support arms 3334 include a length-adjusting mechanism 3350 connected to a first arm 3352 and a second arm 3354. The first arm 3352 is connected to the collar 3332, and the second arm 3354 is connected to the cable pass-through 3336. The length-adjuster 3350 includes a mechanism, and may be a single unit as described below in FIGS. 35 and 36, to control the length of the support arm 3332. In some embodiments, the length-adjuster 3350 operates manually; in other embodiments it may be operated remotely.

In embodiments that operate remotely, to control the length, the length-adjuster 3350 is connected to a Length Control Unit 3360, by any suitable connection 3362, such as a wired connection (including antennas and transmitters, or a wireless connection and associated circuitry. The Length Control Unit 3360 includes suitable circuitry to perform its functions, including controlling the length of the support arm 3320 responsive to an appropriate input.

Figure 35:
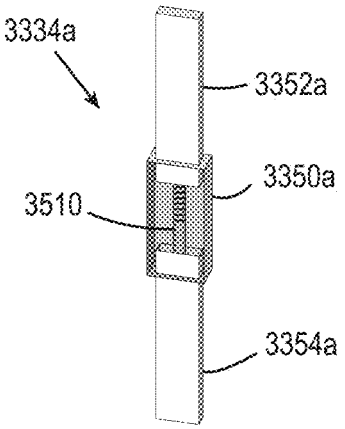
FIG. 35 is a perspective view of one embodiment of a length adjuster in an adjustable support arm.
Figure 36:
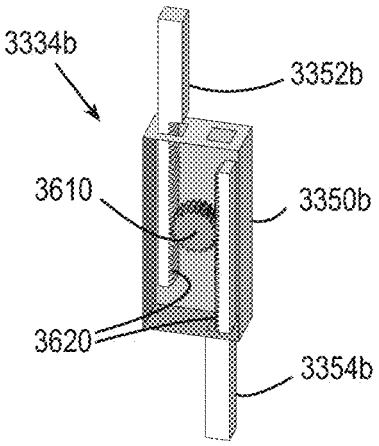
FIG. 36 is a perspective view of another embodiment of a length adjuster in an adjustable support arm.

FIG. 35 is a perspective view of one embodiment of a length adjuster 3350, and FIG. 36 is a perspective view of another embodiment of the length adjuster 3350. FIGS. 35 and 36 both include cutaway sections to show the inside mechanisms.

In the adjustable arm embodiment of FIG. 35 (labeled 3334*a*), the length adjuster 3350*a* includes a threaded bolt 3510 that can be turned manually, such as by a wrench on the head of the bolt (not shown), or remotely by a rotating mechanism such as a motor (not shown) to control the length of the support arm 3334*a*.

In the adjustable arm embodiment of FIG. 36 (labeled 3334*b*), the length adjuster 3350*b* includes a rack and pinion mechanism including a central gear 3610 that may be rotated by a motor or other mechanism (not shown). The central gear 3610 engages with corresponding ridged sections 3620 formed in the first and second arms 3352*b*, 3354*b*. By rotating the central gear 3610 manually or remotely, the first and second arms can be extended or retracted.

FIG. 38 is a perspective view of an alternative embodiment of a brace 3830 in which a collar 3832 includes a clamp that attaches to a BMASS element (not shown). Particularly, the collar 3832 includes a half cylindrical upper bracket 3850 and a half cylindrical lower bracket 3852 that can be attached together and affixed to the BMASS element, which is situated in an opening 3833. The upper bracket 3850 includes a pair of flanges 3851 which fit adjacent to a pair of flanges 3853 in the lower bracket 3853. A bolt and nut 3856 can be affixed through a hole in the flanges to clamp the upper and lower brackets together on the BMASS element. This clamped collar configuration can be utilized in any of braces described herein. In FIG. 38, the brace 3830 includes a support arm 3834 connected to the collar 3832 and a cable pass-through 3836 connected to the support arm 3834. The pass-through 3836 that has an opening 3837 through a cable can pass.

Many different embodiments of the BMASS beam assembly and the BMASS column assembly can be created using the principles disclosed herein. For example, BMASS beam assemblies and BMASS column assemblies can be connected at their ends using conventional techniques (such as clamps) for joining columns and beams, to create many different structures.

(14) GENERAL

Terms and phrases used in this document, and variations thereof, unless otherwise expressly stated, should be construed as open-ended as opposed to limiting. As examples of the foregoing: the term "including" should be read as meaning "including, without limitation" or the like; the term "example" is used to provide examples of instances of the item in a discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the disclosed method and apparatus may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described with the aid of block diagrams, flow charts, and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

(15) PROGRAMMABLE EMBODIMENTS

Some or all aspects of the invention, for example aspects of the algorithmic characteristics of the invention, may be implemented in hardware or software, or a combination of both (e.g., programmable logic arrays). Unless otherwise specified, the algorithms included as part of the invention are not inherently related to any particular computer or other apparatus. In particular, various general purpose computing machines may be used with programs written in accordance with the teachings herein, or it may be more convenient to use a special purpose computer or special-purpose hardware (such as integrated circuits) to perform particular functions. Thus, embodiments of the invention may be implemented in one or more computer programs (i.e., a set of instructions or codes) executing on one or more programmed or programmable computer systems (which may be of various architectures, such as distributed, client/server, or grid) each comprising at least one processor, at least one data storage system (which may include volatile and non-volatile memory and/or storage elements), at least one input device or port, and at least one output device or port. Program instructions or code may be applied to input data to perform the functions described in this disclosure and generate output information. The output information may be applied to one or more output devices in known fashion.

Each such computer program may be implemented in any desired computer language (including machine, assembly, or high-level procedural, logical, or object-oriented programming languages) to communicate with a computer system, and may be implemented in a distributed manner in which different parts of the computation specified by the software are performed by different computers or processors. In any case, the computer language may be a compiled or interpreted language. Computer programs implementing some or all of the invention may form one or more modules of a larger program or system of programs. Some or all of the elements of the computer program can be implemented as data structures stored in a computer readable medium or other organized data conforming to a data model stored in a data repository.

Each such computer program may be stored on or downloaded to (for example, by being encoded in a propagated signal and delivered over a communication medium such as a network) a tangible, non-transitory storage media or device (e.g., solid state memory media or devices, or magnetic or optical media) for a period of time (e.g., the time between refresh periods of a dynamic memory device, such as a dynamic RAM, or semi-permanently or permanently), the storage media or device being readable by a general or special purpose programmable computer or processor for configuring and operating the computer or processor when the storage media or device is read by the computer or processor to perform the procedures described above. The inventive system may also be considered to be implemented as a non-transitory computer-readable storage medium, configured with a computer program, where the storage medium so configured causes a computer or processor to operate in a specific or predefined manner to perform the functions described in this disclosure.

What is claimed is:

1. A cable-supported structural assembly for constructing structures, comprising:

a reinforced concrete BMASS element that has an approximately cylindrical shape having a first end and a second end, including a substantially solid concrete core consisting essentially of concrete;

an outer multi-axially braided reinforcement sleeve embedded in the concrete on the perimeter of the core, the outer reinforcement sleeve having a flexibly braided configuration; and an inner reinforcement sleeve embedded in the concrete situated concentrically within the outer reinforcement sleeve;

wherein the outer and inner reinforcement sleeves provide reinforcement for the BMASS element; and a cable tension system connected between a first end and a second end of the BMASS element for tensioning the BMASS element, including a cable having a first end connected proximate to the first end of the BMASS element, and a second end connected proximate to the second end of the BMASS element; and a brace connected to the BMASS element between the two ends, the brace connected to the cable to transmit tension from the cable to the BMASS element.

2. The assembly of claim 1 wherein the structural assembly is configured as a beam.

3. The assembly of claim 2 wherein the cable is under tension to provide axial compressive force to the BMASS element.

4. The assembly of claim 2 wherein the cable tension provides a curvature to the BMASS element.

5. The assembly of claim 1 wherein the brace includes an arm that is adjustable in length to adjust the tension of the cable.

6. The assembly of claim 5 further including a length control unit connected to the adjustable arm.

7. The assembly of claim 1 further comprising:

a plurality of braces affixed along the BMASS element and connected to the cable;

each brace includes a collar situated around the BMASS element, a support arm, and a cable pass-through connected to the support arm; and the cable is slidably disposed in the cable pass-through.

8. The assembly of claim 1 further including a second cable connected between the first and second ends of the BMASS element.

9. A cable-supported beam, comprising:

a reinforced concrete BMASS element that has an approximately cylindrical shape having a first end and a second end, including;

a substantially solid concrete core consisting essentially of concrete;

an outer multi-axially braided reinforcement sleeve embedded in the concrete on the perimeter of the core, the outer reinforcement sleeve having a flexibly braided configuration; and an inner reinforcement sleeve embedded in the concrete situated concentrically within the outer reinforcement sleeve;

wherein the outer and inner reinforcement sleeves provide reinforcement for the BMASS element; and a cable tension system connected between a first end and a second end of the BMASS element, including a cable having a first end connected proximate to the first end of the BMASS element, and a second end connected proximate to the second end of the BMASS element; and a brace connected to the BMASS element between the two ends, the brace connected to the cable to transmit tension from the cable to the BMASS element.

10. The assembly of claim 9 wherein the cable is under tension to provide axial compressive force to the BMASS element.

11. The assembly of claim 9 wherein the cable tension provides a curvature to the BMASS element.

12. The assembly of claim 9 wherein the brace includes an arm that is adjustable in length to adjust the tension of the cable.

13. The assembly of claim 12 further including a length control unit connected to the adjustable arm.

14. The assembly of claim 9 further comprising:

a plurality of braces affixed along the BMASS element and connected to the cable;

each brace includes a collar situated around the BMASS element, a support arm, and a cable pass-through connected to the support arm; and the cable is slidably disposed in the cable pass-through.

15. The assembly of claim 9 further including:

a second cable connected between the first and second ends of the BMASS element, and wherein the brace includes a second pass-through, and the second cable is slidably disposed in the second pass-through.

16. The assembly of claim 15 wherein the brace includes a collar situated around the BMASS element, a triangle support structure that defines three vertices wherein the first vertex is connected to the collar, the second vertex is connected to the first pass-through, and the third vertex is connected to the second pass-through.

17. The assembly of claim 1 wherein the assembly defines a cable-supported reinforced concrete column, and wherein the cable system comprises:

a multi-cable tension system connected between a first end and a second end of the BMASS element, including at least three cables arranged axially in an approximately equal angle distribution around the BMASS element, each cable having a first end connected proximate to the first end of the BMASS element, and a second end connected proximate to the second end of the BMASS element; and a plurality of braces connected to the BMASS element between the two ends, the braces connected to the cables to transmit tension from the cable to the BMASS element.

18. The assembly of claim 17 wherein able tension of the cables is selected to provide an approximately straight BMASS element.

19. The assembly of claim 17 wherein at least one of the plurality of braces includes a support arm that is adjustable in length.

20. The assembly of claim 17 further comprising:

a plurality of braces affixed along the BMASS element and connected to the cable;

each brace includes a collar situated around the BMASS element, a plurality of support arms connected to the collar, and a plurality of cable pass-throughs, wherein each cable pass-through connected to one of the plurality of support arms; and the cables are slidably disposed in the cable pass-throughs.

* * * * *